US011383922B2

(12) United States Patent
Lee et al.

(10) Patent No.: US 11,383,922 B2
(45) Date of Patent: Jul. 12, 2022

(54) PACKAGING AND DOCKING SYSTEM FOR NON-CONTACT CHEMICAL DISPENSING

(71) Applicant: Ecolab USA Inc., Saint Paul, MN (US)

(72) Inventors: Amy Louise Lee, Ridgeland, WI (US); Kenneth Thomas Dobizl, Mounds View, MN (US); Brian Philip Carlson, Lakeville, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/268,171

(22) Filed: Feb. 5, 2019

(65) Prior Publication Data

US 2019/0241422 A1 Aug. 8, 2019

Related U.S. Application Data

(60) Provisional application No. 62/626,374, filed on Feb. 5, 2018.

(51) Int. Cl.

| | |
|---|---|
| ***D06F 39/02*** | (2006.01) |
| ***B67D 1/12*** | (2006.01) |
| ***B65D 85/84*** | (2006.01) |

(52) U.S. Cl.

CPC ..... *B65D 85/84* (2013.01); *B67D 1/1279* (2013.01); *D06F 39/02* (2013.01); *D06F 39/022* (2013.01)

(58) Field of Classification Search

CPC ..... B67D 1/1279; B67D 1/12; D06F 39/02; D06F 39/022; A47L 15/4445; B65B 39/00; B65B 39/005; B65G 69/183

USPC ..... 141/255, 346

See application file for complete search history.

(56) References Cited

U.S. PATENT DOCUMENTS

| | | | |
|---|---|---|---|
| 1,131,255 | A | 3/1915 | Luellen |
| 1,155,562 | A | 10/1915 | Gilchrist |
| 1,289,487 | A | 12/1918 | Lockwood |
| 1,648,147 | A | 11/1927 | Prudden |

(Continued)

FOREIGN PATENT DOCUMENTS

| | | | |
|---|---|---|---|
| BR | MU8600815 | Y1 | 7/2015 |
| CH | 679374 | A5 | 2/1992 |

(Continued)

OTHER PUBLICATIONS

DE-3143953-A1_English_Translation_of_Specification.pdf (Year: 1983).*

(Continued)

*Primary Examiner* — Mary E McManmon
*Assistant Examiner* — Stephanie A Shrieves
(74) *Attorney, Agent, or Firm* — Fredrikson & Byron, P.A.

(57) ABSTRACT

A chemical dispensing system can include a docking stating that receives a reservoir containing chemical to be dispensed. The reservoir may have a slidable closure covering an opening through which the chemical can be dispensed from the reservoir. The reservoir may be engaged with the docking station so that the slidable closure on the reservoir is operably coupled to a movable element on the docking station. A user can engage the movable element on the docking station to cause a slidable closure on the reservoir to open. As a result, chemical in the reservoir can discharge through the opening uncovered by moving the slidable closure. In this way, the contents of the reservoir may be dispensed without the user coming into physical content with the chemical in the reservoir.

19 Claims, 14 Drawing Sheets

(56) References Cited

U.S. PATENT DOCUMENTS 1,671,285 A 5/1928 Hanna
2,365,916 A 12/1944 Terry et al.
2,431,121 A 11/1947 Hunter
3,067,787 A 12/1962 Salk
3,112,046 A 11/1963 Szekely
3,211,329 A 10/1965 Boyd
3,228,556 A 1/1966 Nonestied
3,511,409 A 5/1970 Huck
3,516,536 A 6/1970 Ino
3,780,735 A 12/1973 Crouter et al.
3,833,147 A 9/1974 Borsum et al.
3,998,238 A 12/1976 Nigro
4,040,515 A 8/1977 Hessel et al.
4,062,385 A * 12/1977 Katusha ..... G03G 15/0882 141/89
4,113,143 A 9/1978 Spagnola
4,174,048 A 11/1979 Volpe, Jr.
4,199,001 A 4/1980 Kratz
4,216,885 A 8/1980 Sedam
4,250,911 A 2/1981 Kratz
4,595,520 A 6/1986 Heile et al.
4,614,286 A * 9/1986 Yamaguchi ..... G03G 15/0882 220/350
4,615,364 A * 10/1986 Kawata ..... G03G 15/0886 222/513
4,676,399 A 6/1987 Burckhardt
4,680,134 A 7/1987 Heile et al.
4,691,732 A 9/1987 Johnson et al.
RE32,763 E 10/1988 Fernholtz et al.
RE32,818 E 1/1989 Fernholz et al.
4,830,509 A 5/1989 Gulmatico
4,887,738 A 12/1989 Jennings et al.
4,984,709 A 1/1991 Weinstein
5,009,561 A 4/1991 Lombardino et al.
5,018,560 A * 5/1991 Tsukamoto ..... G03G 15/0875 141/320
5,040,024 A * 8/1991 Fukuda ..... G03G 15/0882 222/DIG. 1
5,089,854 A * 2/1992 Kaieda ..... G03G 15/0855 141/346
5,091,750 A * 2/1992 Yoshida ..... G03G 15/0886 399/106
5,199,601 A 4/1993 Roethel
5,201,869 A 4/1993 Roethel
5,207,353 A * 5/1993 Corby ..... G03G 15/0882 222/DIG. 1
5,222,628 A 6/1993 Roethel
5,230,433 A 7/1993 Hamilton et al.
5,268,153 A 12/1993 Muller
5,316,688 A 5/1994 Gladfelter et al.
5,337,125 A * 8/1994 Nakano ..... G03G 15/0886 399/263
5,363,177 A * 11/1994 Nakano ..... G03G 15/0882 141/364
5,417,939 A * 5/1995 Bunschoten ..... B01F 1/0027 422/264
5,475,479 A * 12/1995 Hatakeyama ..... G03G 15/0865 399/119
5,490,546 A * 2/1996 Lhoest ..... B65G 69/183 141/18
5,560,516 A 10/1996 Hinterreiter
5,593,068 A * 1/1997 Kitayama ..... G03G 15/0867 141/364
5,947,171 A * 9/1999 Woodruff ..... B65D 81/3211 141/354
5,961,845 A 10/1999 List et al.
5,979,696 A 11/1999 Bode et al.
6,138,703 A * 10/2000 Ferguson ..... B01F 1/0027 137/1
6,177,392 B1 1/2001 Lentsch et al.
6,309,538 B1 10/2001 Khan
6,325,243 B1 12/2001 Bennett
6,432,359 B1 8/2002 Carey et al.
6,435,231 B1 8/2002 Cooper et al.
6,451,271 B1 9/2002 Hammonds
6,779,539 B1 8/2004 Schwamberger et al.
6,910,579 B2 6/2005 Reinke et al.
7,059,759 B2 6/2006 Hummer
7,207,464 B2 4/2007 Brenner
7,300,196 B2 11/2007 Fleig
7,703,621 B2 4/2010 Evans et al.
8,852,442 B2 * 10/2014 Hayas ..... B01F 1/0033 210/749
8,889,048 B2 11/2014 Stolte et al.
9,452,457 B2 9/2016 Denvir et al.
2002/0025193 A1 * 2/2002 Boogert ..... G03G 15/0886 399/258
2002/0195404 A1 12/2002 Pickens et al.
2003/0146237 A1 8/2003 Costa
2004/0065672 A1 4/2004 Kaplan
2005/0244315 A1 * 11/2005 Greaves ..... C02F 1/688 422/264
2006/0048841 A1 3/2006 Luehrsen et al.
2006/0201774 A1 9/2006 Seiffert et al.
2007/0051739 A1 3/2007 Giraud
2007/0170203 A1 7/2007 Jarisch et al.
2008/0296214 A1 12/2008 Blanchette
2009/0308889 A1 12/2009 Lindsay et al.
2010/0294791 A1 11/2010 Weibel et al.
2011/0036454 A1 2/2011 Saito et al.
2011/0168608 A1 7/2011 Gaffey
2012/0067968 A1 3/2012 Brennan et al.
2012/0138544 A1 6/2012 Barani
2013/0098820 A1 4/2013 King et al.
2013/0294978 A1 * 11/2013 Mariano ..... B01F 15/00993 422/261
2014/0054210 A1 2/2014 King et al.
2014/0084018 A1 3/2014 Onillon et al.
2017/0052051 A1 2/2017 Emmert
2017/0153575 A1 6/2017 Schulkes et al.
2017/0332661 A1 11/2017 McGill et al.
2020/0031512 A1 * 1/2020 McAleavy ..... B65B 69/0075

FOREIGN PATENT DOCUMENTS

CN 1134749 A 10/1996
CN 101226363 A 7/2008
CN 206842145 U 1/2018
DE 3143953 A1 * 5/1983 ..... B65D 83/0418
DE 3143953 A1 5/1983
EP 176960 A2 4/1986
EP 236039 A2 9/1987
EP 0514168 A2 11/1992
EP 0514168 B1 * 9/1998 ..... G03G 15/0882
EP 1118588 A2 7/2001
EP 334472 B1 12/2002
EP 1961668 A1 8/2008
EP 2131885 B1 6/2013
FR 2750780 A1 1/1998
FR 2898114 A1 9/2007
FR 2935691 A1 3/2010
GB 1228062 A 4/1971
JP H04-369668 A 12/1992
JP 2009286435 A 12/2009
JP 2012171683 A 9/2012
JP 2012171685 A 9/2012
JP 2013079090 A 5/2013
SU 1193012 A2 11/1985
SU 1219415 A1 3/1986
WO 8500156 A1 1/1985
WO 9117103 A1 11/1991
WO 9318985 A1 9/1993
WO 9728066 A1 8/1997
WO 0029306 A1 5/2000
WO 0063087 A1 10/2000
WO 0123065 A1 4/2001
WO 03013962 A1 2/2003
WO 03086901 A1 10/2003
WO 2005004785 A2 1/2005
WO 2007039779 A1 4/2007
WO 2007068059 A1 6/2007

(56) References Cited

FOREIGN PATENT DOCUMENTS

| | | | |
|---|---|---|---|
| WO | 2007125353 | A1 | 11/2007 |
| WO | 2008089306 | A2 | 7/2008 |
| WO | 2009080309 | A2 | 7/2009 |
| WO | 2014033080 | A1 | 3/2014 |
| WO | 2016010352 | A1 | 1/2016 |
| WO | 2017123496 | A1 | 7/2017 |

OTHER PUBLICATIONS

Dickason et al., "RingCap Technology," Drugs and the Pharmaceutical Sciences, vol. 126, Modified-Release Drug Delivery Technology, 2003, Section 5, pp. 49-57.

International Patent Application No. PCT/US2019/016668, International Search Report and Written Opinion dated Apr. 17, 2019, 15 pages.

U.S. Appl. No. 16/782,559, entitled Packaging and Docking System for Non-Contact Chemical Dispensing, filed Feb. 5, 2020, 28 pages.

* cited by examiner

PACKAGING AND DOCKING SYSTEM FOR NON-CONTACT CHEMICAL DISPENSING

RELATED MATTERS

This application claims priority to U.S. Provisional Patent Application No. 62/626,374, filed Feb. 5, 2018, the entire contents of which are incorporated herein by reference.

TECHNICAL FIELD

This disclosure relates to chemical product dispensing including packaging and docking systems for holding and dispensing chemical products.

BACKGROUND

Chemical product dispensers are useful in many different chemical application systems, including water treatment systems like commercial cooling water systems, cleaning systems relating to food and beverage operations, laundry operations, warewashing operations (e.g., dishwashers), pool and spa maintenance, as well as other systems, such as medical operations. For example, chemical products used in water treatment systems may include oxidizing and non-oxidizing biocides to inhibit or destroy growth or activity of living organisms in the water being treated. As another example, chemical products used in food and beverage operations may include sanitizers, sterilants, cleaners, degreasers, lubricants, etc. Chemical products used in a warewashing or laundry operation may include detergent, sanitizers, stain removers, rinse agents, etc. Chemical products used in a laundry operation may include detergent, bleaches, stain removers, fabric softeners, etc. Chemical products used in cleaning of medical/surgical instrumentation may include detergents, cleaning products, neutralizers, sanitizers, disinfectants, enzymes, etc.

For low volume and non-commercial applications, chemical products are often provided in ready-to-use form. The chemical product may be formulated at the correct concentration for the intended application and may be applied directly without diluting or otherwise modifying the chemical composition of the product. In other applications, such as high-volume use facilities and commercial applications, a desired chemical product may be formed on site from one or more concentrated chemical components. The concentrated chemical may be introduced into an automated dispenser system where the chemical is contacted with water to form a dilute, ready-to-use solution.

Providing concentrated chemical product to a user that is then diluted on site is useful to reduce packaging, shipping, and storage requirements that would otherwise be needed to provide an equivalent amount of product in ready-to-use form. However, a user receiving concentrated chemical typically needs to transfer the chemical from the container in which it is received into a dispenser system that formulates the ready-to-use solution. If performed incorrectly, the concentrated chemical may be spilled during transfer, potentially exposing the user to the chemistry or otherwise creating an environmental cleanup issue.

SUMMARY

In general, this disclosure relates to packaging for chemical products and dispenser systems for transferring a chemical product from a package to a desired dispense location. The packaging and dispenser may work cooperatively to provide safe, non-contact transfer of chemical product out of the packing in which it is stored through the dispenser and into a dilution system or other receiving reservoir attached to the dispenser. In some examples, the dispenser is a configured as a docking station. The chemical product can be shipped to the user in a reservoir that provides a barrier between the chemical contained in the reservoir and the exterior environment. The user can engage the reservoir with the docking station and further manipulate the docking station to open the reservoir. As a result, chemical in the reservoir can discharge through the opening uncovered by manipulation of the docking station. In this way, the contents of the reservoir may be dispensed without the user coming into physical content with chemical contained in the reservoir.

While the packaging in which the chemical product is stored can have a variety of different configurations, in some examples, the packing includes a reservoir closed with a slidable closure. The slidable closure can selectively cover and uncover a reservoir opening through which chemical can be dispensed. The slidable closure may be mounted on one or more rails along which the slidable closure can translate to open and close the reservoir. The reservoir opening may progressively increase as the slide is translated from a closed position to an open position, thereby progressively increasing the cross-sectional area of the opening through which chemical contained in the reservoir can be dispensed.

The reservoir containing the slidable closure may be docked in a docking station that has a docking station slide. Upon inserting the reservoir in the docking station, the slidable closure on the reservoir may be operatively coupled to the docking station slide. For example, the slidable closure on the reservoir and the docking station slide may have complementary connection features that engage to form a mechanical linkage between the two components. In some configurations, the docking station slide has a handle accessible from the exterior of the docking station. A user may grasp the handle and translate the docking station slide thereby causing the slidable closure on the reservoir to translate through the mechanical linkage formed by the complementary connection features between the docking station slide and the slidable closure on the reservoir.

During use, an unopened reservoir containing chemical to be dispensed may be inserted into the docking station and opened by engaging the docking station slide. Some or all of the contents of the reservoir may dispense into an intended discharge reservoir, such as a product dispenser that receives concentrated chemical and prepares a target solution from the concentrated chemical. In this manner, the chemical product to be dispensed may be stored, shipped, and transferred out of the reservoir in which it is held without the user needing to directly contact or interact with the chemical contained in the reservoir.

In one example, a chemical dispensing system is described that includes a reservoir, a docking flange, and a docking station. The reservoir is configured to contain a chemical to be dispensed. The reservoir has a closed top end, a bottom end defining an opening through which the chemical is dispensed, and at least one sidewall connecting the top end to the bottom end. The docking flange extends from the bottom end of the reservoir. The docking flange contains a slidable closure configured to slide from a position in which the slidable closure closes the opening of the reservoir to prevent the chemical from discharging through the opening to a position in which the slidable closure is offset from the opening and the chemical is allowed to discharge past the slidable closure through the opening. The docking station has a discharge aperture and a docking station slide. The docking station is configured to receive and hold the docking flange extending from the bottom end of the reservoir with the opening of the reservoir aligned with the discharge aperture of the docking station. The example specifies that the slidable closure and the docking station slide have corresponding mating features that cause the slidable closure to engage with the docking station slide, when the docking flange extending from the bottom end of the reservoir is inserted into the docking station, such that the slidable closure is configured to move with the docking station slide.

In another example, a chemical dispensing reservoir is described that includes a reservoir configured to contain a chemical to be dispensed. The reservoir has a closed top end, a bottom end defining an opening through which the chemical is dispensed, and at least one sidewall connecting the top end to the bottom end. The chemical dispensing reservoir also includes a docking flange extending from the bottom end of the reservoir. The docking flange contains a slidable closure configured to slide from a position in which the slidable closure closes the opening of the reservoir to prevent the chemical from discharging through the opening to a position in which the slidable closure is offset from the opening and the chemical is allowed to discharge past the slidable closure through the opening. The example specifies that a bottom surface of the slidable closure includes one of a projection and a protrusion configured to mate with a corresponding protrusion or projection a docking station slide.

In another example, a method of dispensing chemical is described. The method includes inserting a reservoir containing chemical that is held in the reservoir by a slidable closure into a docking station, the docking station having a docking station slide closing a discharge aperture extending through the docking station. The method also includes engaging the slidable closure on the reservoir with the docking station slide. The method further includes sliding the docking station slide and thereby simultaneously sliding the slidable closure on the reservoir engaged therewith, causing an opening through a bottom end of the reservoir to open simultaneously with the discharge aperture.

The details of one or more examples are set forth in the accompanying drawings and the description below. Other features, objects, and advantages will be apparent from the description and drawings, and from the claims.

DETAILED DESCRIPTION

This disclosure generally relates to chemical packaging and dispenser systems. In some examples, a chemical is packaged in a reservoir that surrounds and holds the chemical for later discharge. The reservoir may have a closed top end, a bottom end that defines an opening, and one or more sidewalls surrounding the sides of the reservoir. The bottom end of the reservoir may include a slide that can translate to selectively open and close the discharge opening of the reservoir. In some examples, the bottom end of the reservoir also includes a docking flange. The docking flange may be inserted into a receiving cavity of a corresponding docking station and, in some examples, rotated to releasably lock the reservoir in the docking station. Once the reservoir is suitably positioned in the docking station, a user may translate a docking station slide operatively coupled to the reservoir slide, thereby causing the reservoir slide to translate concurrently with movement of the docking station slide. Since the reservoir can be inserted into the docking station without first being opened in such a configuration, the likelihood of the user coming into contact with the contents of the reservoir is reduced as compared to if the user is required to manually open and dump the contents of the reservoir.

Figure 1:
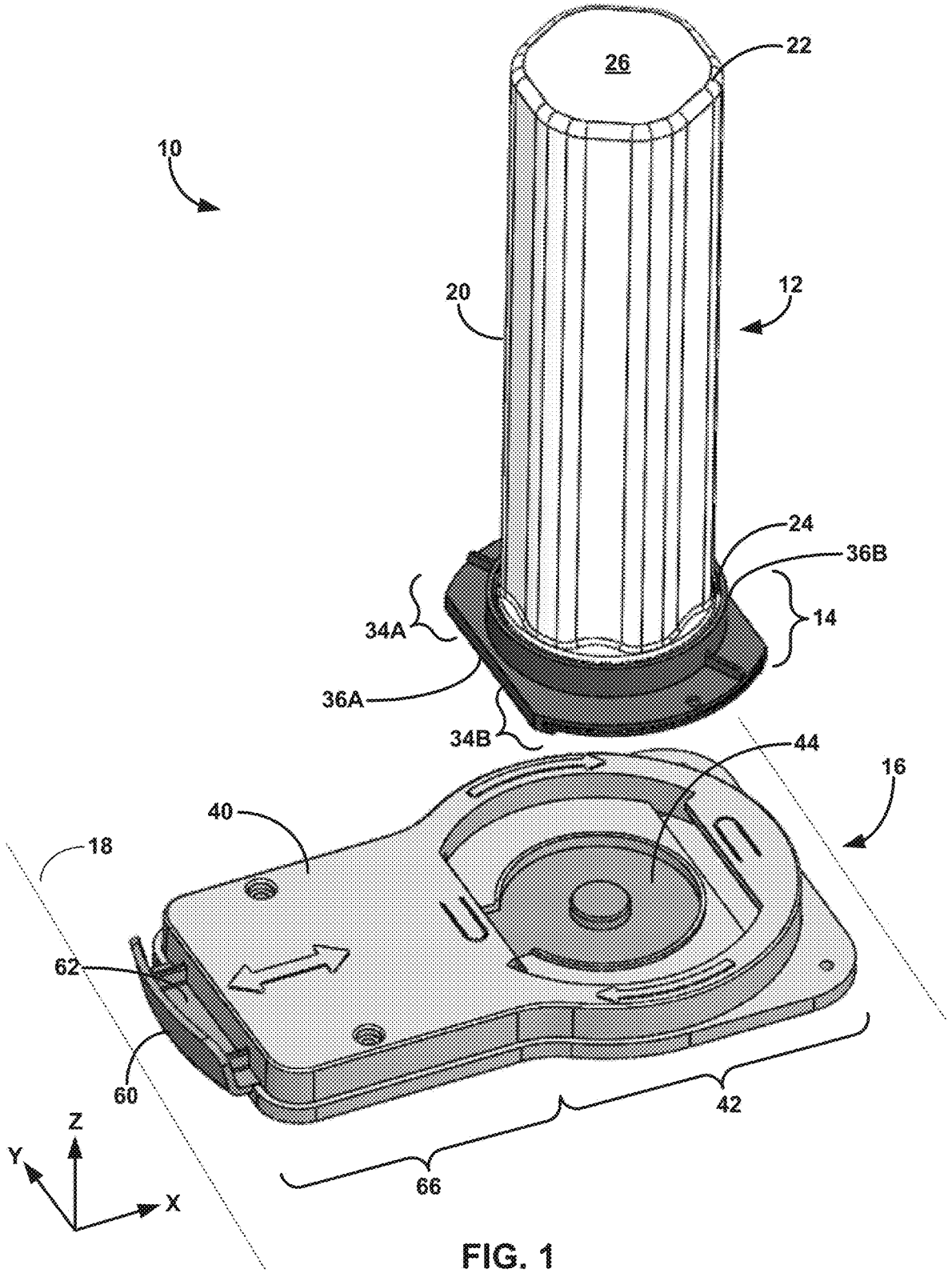
FIG. 1 is a perspective view of an example chemical dispensing system.

FIG. 1 is a perspective view of an example chemical dispensing system 10 that includes a reservoir 12, a docking flange 14, and a docking station 16. Reservoir 12 can be configured to hold any desired chemical to be dispensed, examples of which are discussed in greater detail below. Docking flange 14 may be coupled to reservoir 12 and configured for engagement with docking station 16 to attach the reservoir to the docking station. Docking station 16 can receive reservoir 12 by inserting docking flange 14 into the docking station. In practice, docking station 16 may be permanently or removably attached to a receiving reservoir 18 that is intended to receive the discharged contents of reservoir 12.

As discussed in greater detail below, reservoir 12 may be inserted into docking station 16 by engaging docking flange 14 carried by the reservoir with the docking station. Reservoir 12 may be closed when inserted into docking station 16 such that an operator does not need to pre-open the reservoir prior to inserting the reservoir into the docking station. Rather, the operator may insert the closed reservoir 12 into docking station 16 and thereafter engage the docking station to remotely open the reservoir. For example, the process of inserting docking flange 14 into docking station 16 may cause a mating feature on a movable closure of the reservoir to become operatively connected to a corresponding mating feature of the docking station. The operator may indirectly open the closure covering the reservoir by engaging the docking station which, in turn, engages the closure through a connection between the closure and docking station. As a result, the operator may dispense the contents of reservoir 12 while minimizing the likelihood of inadvertent contact with chemical contained in the reservoir during the transfer process.

In general, reservoir 12 may be any structure configured to contain a chemical to be dispensed. Reservoir 12 may define a bounded cavity that partially or fully separates the contents therein from the external environment. Reservoir 12 may be formed by at least one sidewall 20 that extends from a terminal top end 22 to a terminal bottom end 24. In some examples, such as the example illustrated in FIG. 1, the top end 22 of reservoir 12 may be completely closed by a top wall 26. In other examples, the top end 22 of reservoir 12 may be partially or fully open, e.g., defining an opening sized less than the contents in reservoir 12 such that the contents cannot come out through the top opening. In either case, the bottom end 24 of reservoir 12 may be open (e.g., such that the contents of the reservoir can communicate with the external environment through the opening) but selectively closable with a slidable closure as described in greater detail below.

It should be appreciated that the descriptive terms "top" and "bottom" with respect to the configuration and orientation of components described herein are used for purposes of illustration based on the orientation in the figures. The arrangement of components in real world application may vary depending on their orientation with respect to gravity. Accordingly, unless otherwise specified, the general terms "first" and "second" may be used interchangeably with the terms "top" and "bottom" with departing from the scope of disclosure.

In the example of FIG. 1, reservoir 12 includes at least one sidewall 20. Sidewall 20 extends upwardly (in the Z-direction indicated on FIG. 1) from bottom end 24. The number of sidewalls interconnected together to form the side structure of reservoir 12 extending between the top and 22 and bottom end 24 may vary depending on the shape of the reservoir. For example, a reservoir with a circular cross-sectional shape (e.g., in the X-Y plane) may be formed of a single sidewall whereas a reservoir with a square or rectangular cross-sectional shape may be defined by four interconnected sidewalls.

In general, reservoir 12 can define any polygonal (e.g., square, hexagonal) or arcuate (e.g., circular, elliptical) shape, or even combinations of polygonal and arcuate shapes. In some examples, such as the example shown in FIG. 1, reservoir 12 includes one or more recesses or dimples projecting radially inwardly and extending at least partially along the axial length of the reservoir. Such recess(es) may help prevent chemical contained in the reservoir from moving during shipping, reducing the likelihood of product breakage or dusting. Reservoir 12 can be fabricated from a material that is chemically compatible with and chemically resistant to the type of chemical placed in the reservoir. In some examples, reservoir 12 is fabricated from a polymeric material, such as a molded plastic.

Reservoir 12 can define any suitable size, and the specific dimensions of the reservoir may vary depending on the volume of chemical intended to be held by the reservoir. In some configurations, reservoir 12 defines a height (in the Z-direction indicated on FIG. 1) greater than a width and/or length (in the X-Y plane). When so configured, reservoir 12 may be elongated in the vertical direction relative to the horizontal plane. This configuration may be useful for orienting chemical contained in the reservoir in a vertically stacked alignment, which may help the chemical subsequently dispense under the force of gravity out of the reservoir upon being opened. In other configurations, however reservoir 12 may have a width and/or length (in the X-Y plane) that is equal to or greater than the height (in the Z-direction indicated on FIG. 1).

While the size of reservoir 12 may vary, in some examples, the reservoir is designed to hold from 0.5 to 5 liters of chemical. For example, reservoir 12 may have a height in the Z-direction indicated in FIG. 1 ranging from 5 to 50 centimeters. Reservoir 12 may further define a cross-sectional area in the X-Y plane indicated on FIG. 1 ranging from 10 to 120 square centimeters. It should be appreciated that the foregoing dimensions are merely examples, and a reservoir in accordance with the disclosure is not limited in this respect.

Chemical dispensing system 10 in the example of FIG. 1 also includes docking flange 14. Docking flange 14 may be a flat rim, a collar, a rib, or other feature or features that cooperate with docking station 16 to facilitate engagement between the docking flange and docking station. For example, docking flange may define one or more protrusions and/or recesses that engage with corresponding recesses and/or protrusions on docking station 16 to facilitate mechanical interconnection between the components.

In some examples, docking flange 14 is integrally formed with reservoir 12 (e.g., by molding or casting) such that the docking flange and reservoir form a unitary, permanently joined structure. In other examples, docking flange 14 may be fabricated separately from reservoir 12 and joined to the reservoir thereafter. Any suitable fixation techniques can be used to join docking flange 14 to reservoir 12 in such configurations, such as cooperative threading between the components, snap-on fittings between the components, spin welding, adhesive bonding, or other joining technique.

Independent of the manner in which docking flange 14 is formed, the docking flange may be positioned adjacent the bottom end 24 of reservoir 12. In some examples, docking flange 14 may extend from the bottom end 24 of reservoir 12. In configurations where the reservoir 12 and docking flange 14 are integrally formed, the docking flange may extend from the bottom end of the reservoir in that the integrally formed flange region may form the bottommost portion of the structure with the reservoir region containing chemical to be dispensed being provided coplanar with or above the flange region. In other configurations where docking flange 14 is joined to reservoir 12, the bottom end 24 of reservoir 12 may be joined with docking flange 14, e.g., with the docking flange projecting downwardly from the bottom and of the reservoir.

Figure 2B:
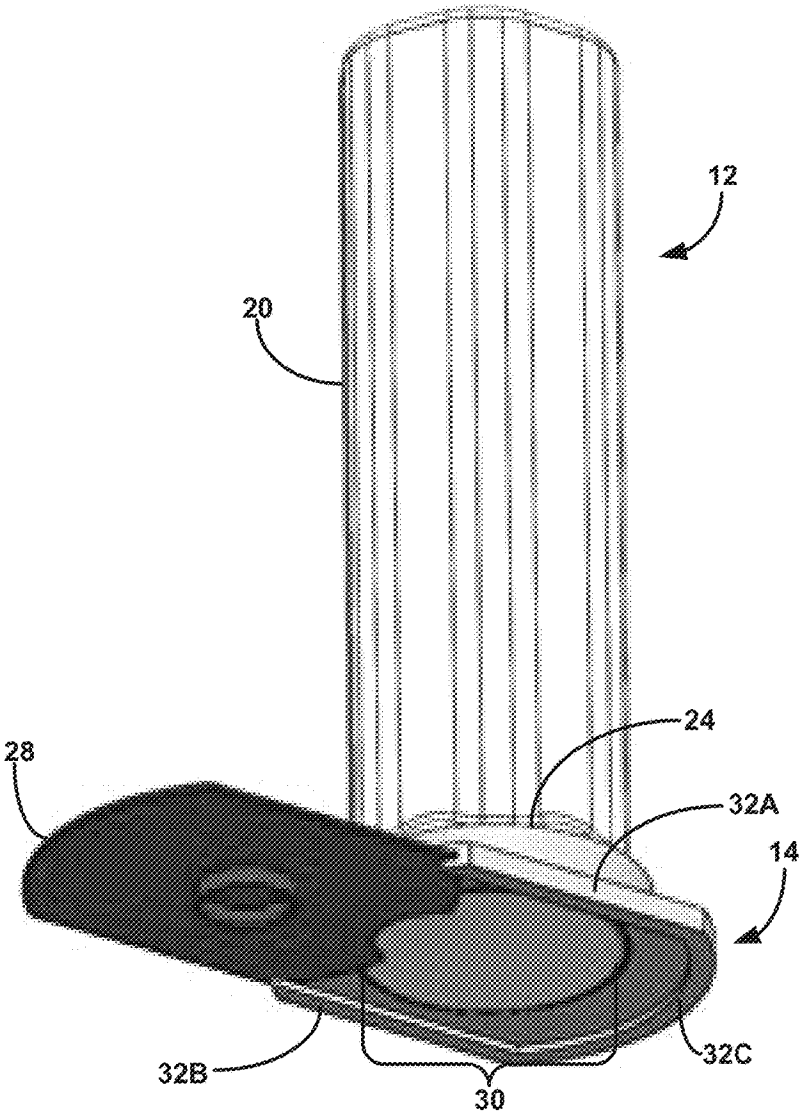
FIGS. 2A and 2B are bottom perspective views of an example configuration of a docking flange showing an example slidable closure.
Figure 2A:
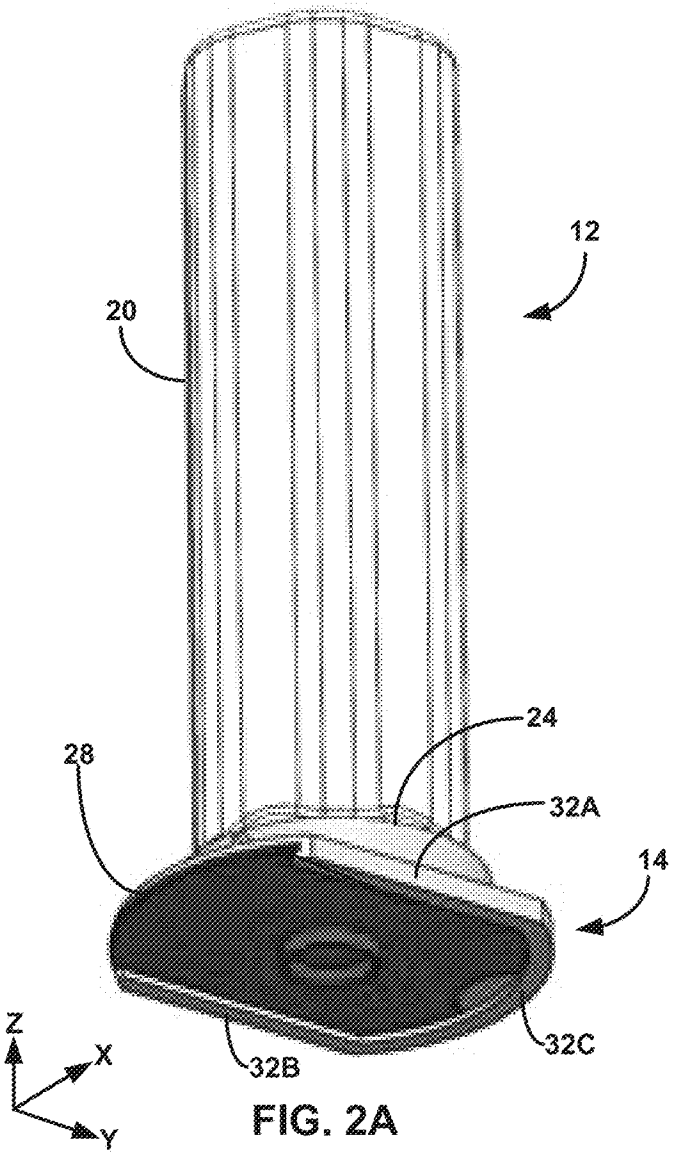

In addition to facilitating interconnection between reservoir 12 and docking station 16, docking flange 14 may include a slidable closure that is operable to open and close the bottom end 24 of reservoir 12. FIGS. 2A and 2B are bottom perspective views of an example configuration of docking flange 14 showing an example slidable closure 28. FIG. 2A illustrates slidable closure 28 in a closed position whereas FIG. 2B illustrates the slidable closure in an open position revealing opening 30 through which chemical can dispensed from the reservoir.

In the example of FIGS. 2A and 2B, slidable closure 28 is illustrated as a generally planar member that is slidably coupled to docking flange 14 via at least one channel, which is illustrated as a pair of laterally spaced apart channels 32A and 32B (collectively "channels 32"). Channels 32 may define a pocket bounded on the top side and the bottom side having a gap size substantially equal to and/or slightly greater than the thickness of slidable closure 28. Further, channels 32 may be separated from each other a distance substantially equal to the width of slidable closure 28. Accordingly, slidable closure 28 may slide along and/or through channels 32 to translate from open and close positions.

In some examples, such as the example illustrated on FIGS. 2A and 2B, channels 32 surround slidable closure 28 about its perimeter except for one side which provides an opening for directed translation of the slidable closure. For example, as illustrated, channels 32 bound the widthwise sides of slidable closure 28 and an additional channel segment 32C bounds one of the lengthwise sides of the slidable closure. Accordingly, slidable closure 28 can translate laterally (e.g., in the negative Y-direction indicated on FIGS. 2A and 2B) through the one side of the docking flange not bounded by a channel to open and close opening 30 through the bottom end of the reservoir. Depending on the size and configuration of the system, slidable closure 28 may be able to slide at least 2 inches from a fully closed position to an open position, such as at least 4 inches, at least 6 inches, or at least 1 foot. For example, slidable closure may translate between 2 inches and 12 inches moving from a fully closed position to a fully open position.

In some examples, such as the example illustrated in FIGS. 2A and 2B, the channels 32 through which slidable closure slides during movement also form part of the flange surface that engages with docking station 16 to connect reservoir 12 to the docking station. For example, the inner surface of docking flange 14 defining channel 32 that bound slidable closure 28 while an outer surface of the docking flange may contact docking station 16. In other configurations, the channels retaining and guiding slidable closure 28 may be offset and/or separate from the portion of docking flange 14 that engages with docking station 16.

As briefly noted above, docking flange 14 can have a variety of structural features that cooperate with docking station 16 to facilitate engagement and/or interlocking between the docking flange and docking station. In the example of FIG. 1, docking flange 14 is illustrated as having at least one wing which, in the illustrated example, is shown as two wings 34A and 34B (collectively "wings 34"). Wings 34 project outwardly from reservoir 12 so as to define a structure of greater cross-sectional area (in the X-Y plane illustrated on FIG. 1) than the cross-sectional area of reservoir 12. In some examples, wings 34 may project away from the exterior surface of reservoir 12 at least 10 cm, such as at least 25 cm, or from 5 cm to 75 cm.

Wings 34 are positioned on opposite sides of reservoir 12 (e.g., projecting 180° away from each other) but may be configured to project at a different angle relative to each other in other examples. Wings 34 are illustrated as having substantially circular edges joined together by chamfered or planar side edges 36A and 36B also extending outside of the exterior perimeter of reservoir 12. Other types of edge shapes and configurations are possible. The surface(s) of docking flange 14 that are configured to engage with corresponding surface(s) of docking station 16 can define any polygonal (e.g., square, hexagonal) or arcuate (e.g., circular, elliptical) shape, or even combinations of polygonal and arcuate shapes. In addition, although docking flange 14 is illustrated as having two wings, it should be appreciated that a docking flange according to the disclosure may have fewer wings (e.g., no wings or a single wings), or more wings (e.g., three, four, or more), while still providing a flange function.

Chemical dispensing system 10 also includes docking station 16. Docking station 16 can receive reservoir 12 and hold the reservoir via docking flange 14. Docking station 16 can further engage slidable closure 28 to facilitate contactless opening of the slidable closure. In operation, a user can insert docking flange 14 into docking station 16 and, in some examples, interlock the docking flange to the docking station. Thereafter, the user may manipulate the docking station to open slidable closure 28, thereby allowing the contents of reservoir 12 to be dispensed through uncovered opening 30.

Figure 3A:
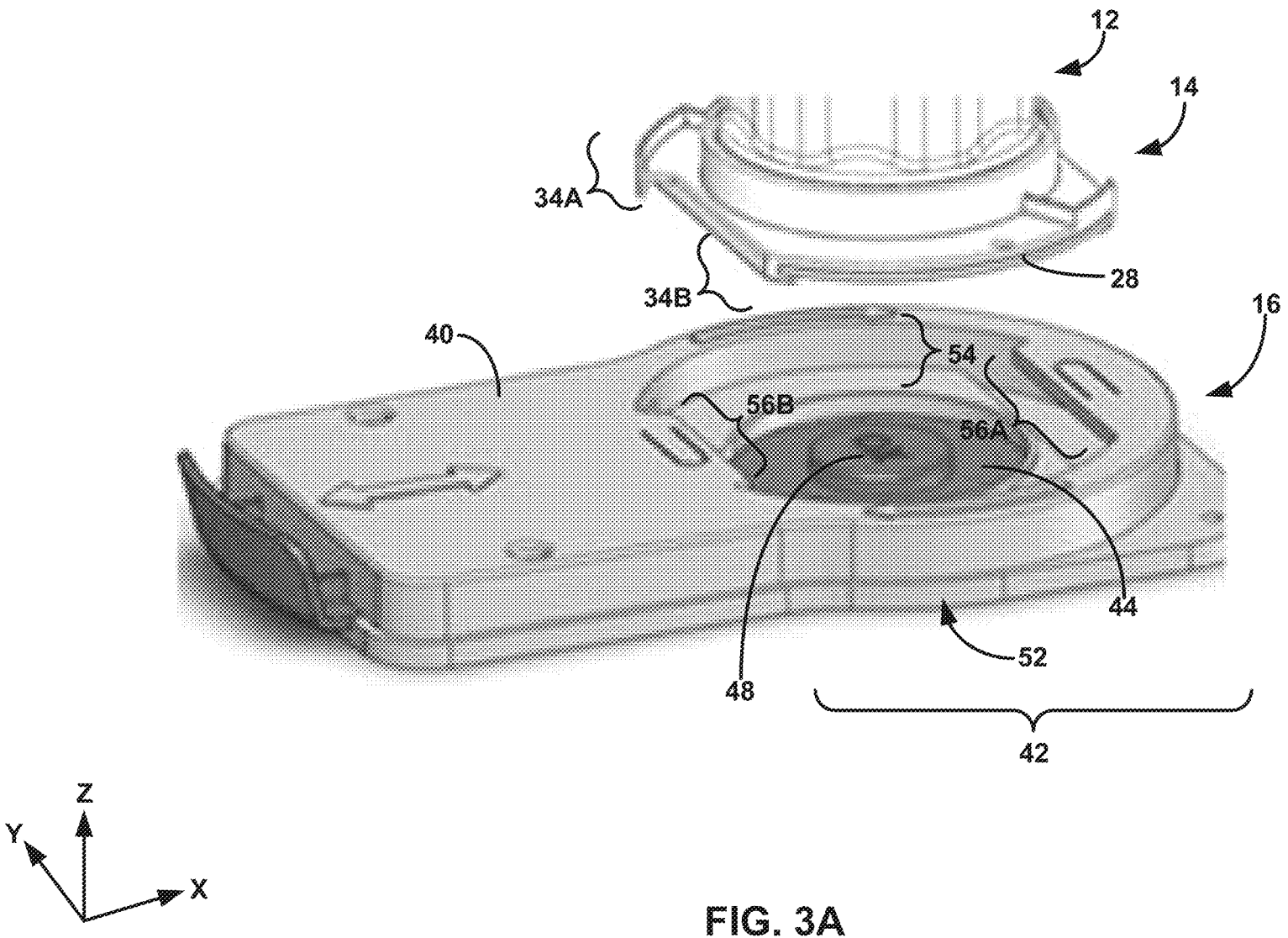
FIGS. 3A and 3B are top and bottom perspective views, respectively, illustrating an example docking station configuration that can be used in the system of FIG. 1.
Figure 3B:
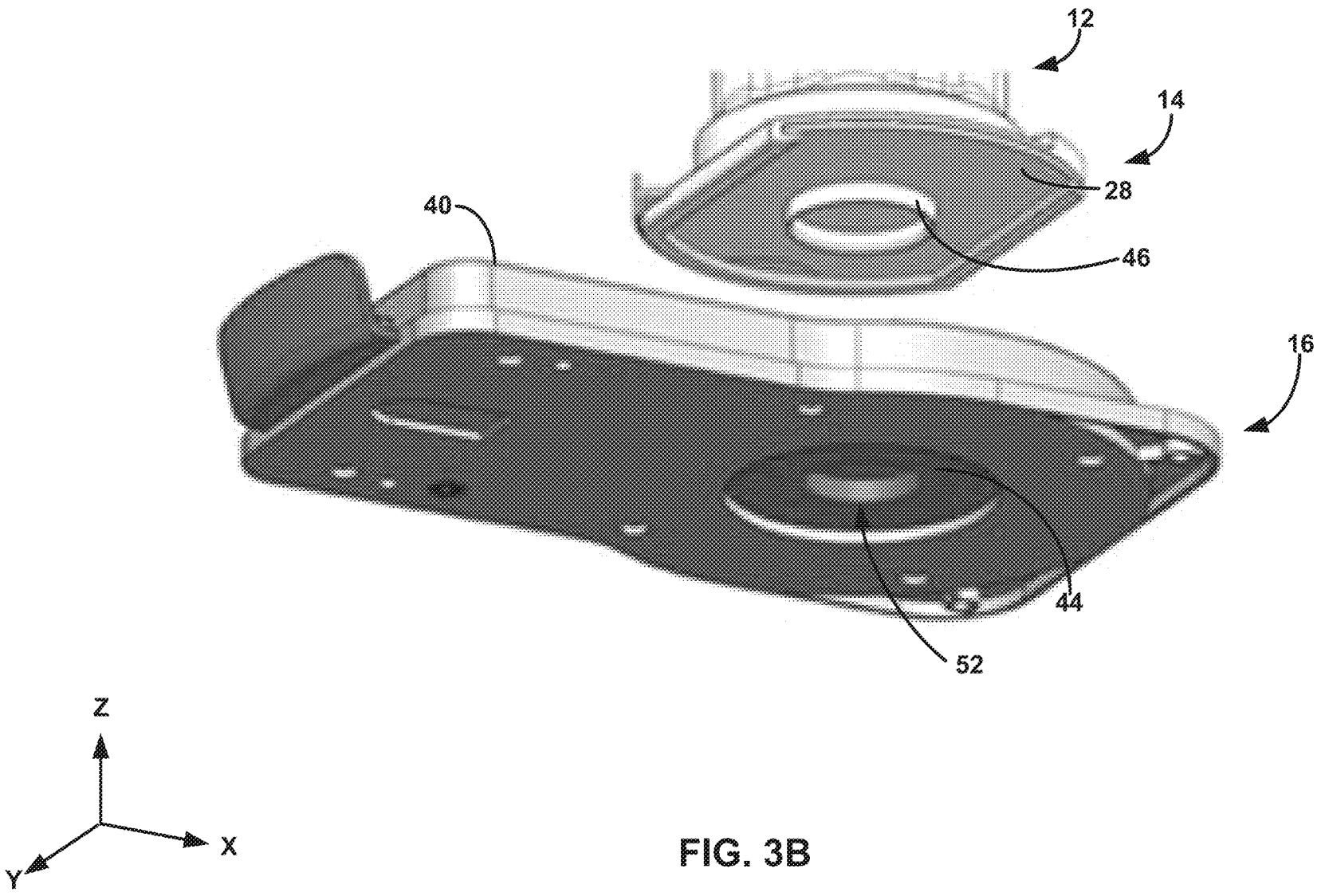

FIGS. 3A and 3B are top and bottom perspective views, respectively, illustrating an example docking station configuration that can be used in the system of FIG. 1. In the illustrated example, docking station 16 includes a housing 40 that defines a reservoir receiving portion 42. Docking station 16 also includes a docking station slide 44. Upon inserting docking flange 14 into docking station 16, slidable closure 28 that retains the contents in reservoir 12 may become operatively coupled to docking station slide 44. For example, slidable closure 28 and docking station slide 44 may have corresponding mating features that overlap, interlock, and/or otherwise engage with each other when reservoir 12 is properly inserted into docking station 16 (e.g., by inserting docking flange 14 that is part of or coupled to reservoir 12 into the docking station). When reservoir 12 is properly inserted into docking station 16, a mechanical linkage or interconnection may be formed between slidable closure 28 and docking station slide 44. Accordingly, when docking station slide 44 is subsequently moved, slidable closure 28 on reservoir 12 may move via the linkage or interconnection between the two components.

In general, any complementary sized and/or shaped features (e.g., size and/or shape indexed features) between slidable closure 28 and docking station slide 44 may be used to form a connection between the components. For example, slidable closure 28 may have one or more projections and/or protrusions on a bottom surface of the slidable closure that are positioned to engage with one or more corresponding protrusions and/or projections on a top surface of docking station slide 44. In the illustrated example, slidable closure 28 defines a ring or annulus 46 extending downwardly from the otherwise planar bottom surface of the closure. By contrast, docking station slide 44 defines a cylindrical projection 48 extending upwardly from the otherwise planar top surface of the slide. The annulus 46 on slidable closure 28 can be size indexed to cylinder 48 on docking station slide 44 such that, when reservoir 12 is properly inserted into docking station 16, the cylinder will project up into the annulus such that the inner wall surfaces of the annulus at least partially surround the cylinder. In this way, a mechanical linkage can be established between slidable closure 28 and docking station slide 44. When docking station slide 44 is moved, cylinder 48 can bear against annulus 46, causing slidable closure 28 to move concurrent with the docking station slide.

In practice, a chemical provider may supply different chemicals in similar reservoirs that are intended to be deployed for different applications. To help ensure that the end user does not inadvertently dispense the wrong chemical using chemical dispensing system 10, a system of different mating features between slidable closure 28 and docking station slide 44 may be provided. For example, slidable closure 28 may have a first type (e.g., size and/or shape) of mating feature(s) if reservoir 12 holds one type of chemical product and a second type (e.g., size and/or shape) of mating feature(s) different than the first type if reservoir 12 holds a different type of chemical product. Docking station slide 44 may have complementary mating feature(s) to the first type of mating feature(s) on slidable closure 28 if the docking station 16 is associated with a discharge location intended to receive the first type of chemical product. Similarly, docking station slide 44 may have complementary mating feature(s) to the second type of mating feature(s) on slidable closure 28 if the docking station 16 is associated with a discharge location intended to receive the second type of chemical product. While the foregoing example described a system with two types of different chemical products, it should be appreciated that the system may be expanded with additional sets of complementary mating features to accommodate additional chemical products. Each type of complementary mating features may be incompatible with each other type of mating features, e.g., such that a user cannot successfully insert an incorrect reservoir into a docking station intended to receive a reservoir containing a different type of chemical product.

Figure 4A:
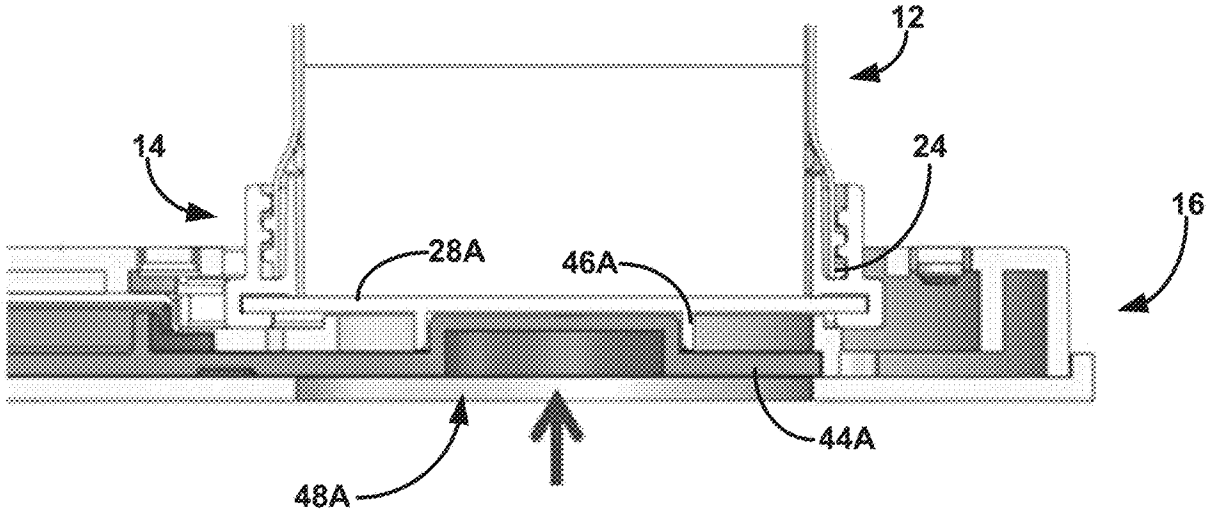
FIGS. 4A and 4B are side views of the example docking station configuration from FIG. 1 showing different example sized complementary connection features.
Figure 4B:
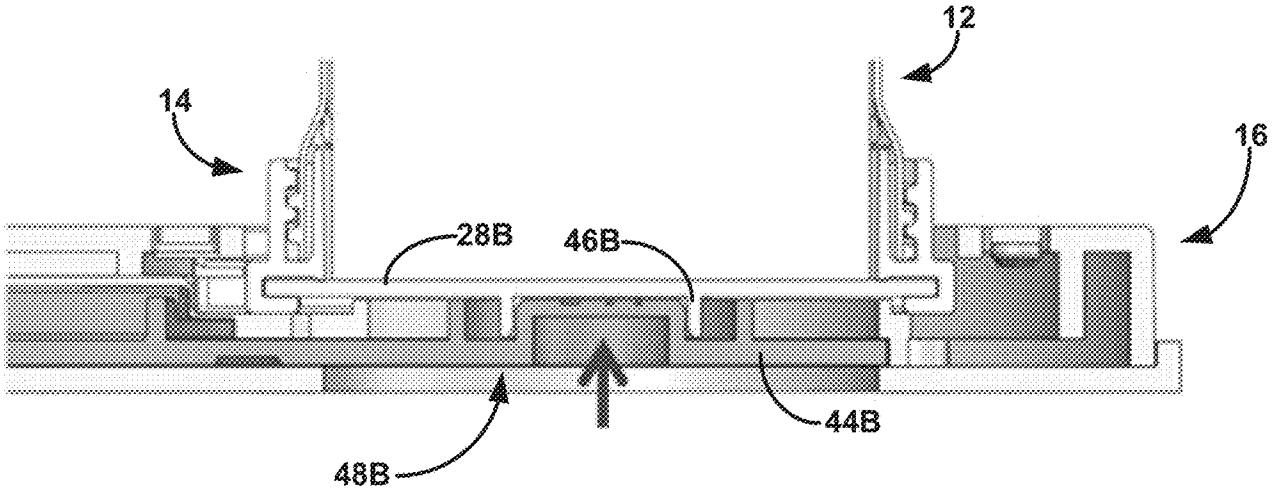

As one example of such a system configuration, the size (e.g., diameter) of the complementary mating features on slidable closure 28 and docking station slide 44 may vary based on the type of chemical product to be dispensed. FIGS. 4A and 4B are side views of the example docking station configuration from FIG. 1 showing different example sized complementary connection features that may be used on slidable closure 28 and docking station slide 44. In these examples, cylinder 48A projecting up from docking station slide 44A in FIG. 4A has a larger diameter than the diameter of the cylinder 48B in the example of FIG. 4B. Likewise, annulus 46A projecting down from slidable closure 28A in FIG. 4A has a larger diameter than the diameter of annulus 46B in the example of FIG. 4B. As a result of this arrangement, reservoir 12 in FIG. 4A cannot be inserted into docking station 16 in the example of FIG. 4B and vice versa. Rather, the connection features carried on slidable closure 28 and docking station slide 44 of each respective embodiment is incompatible with each other.

Figure 5B:
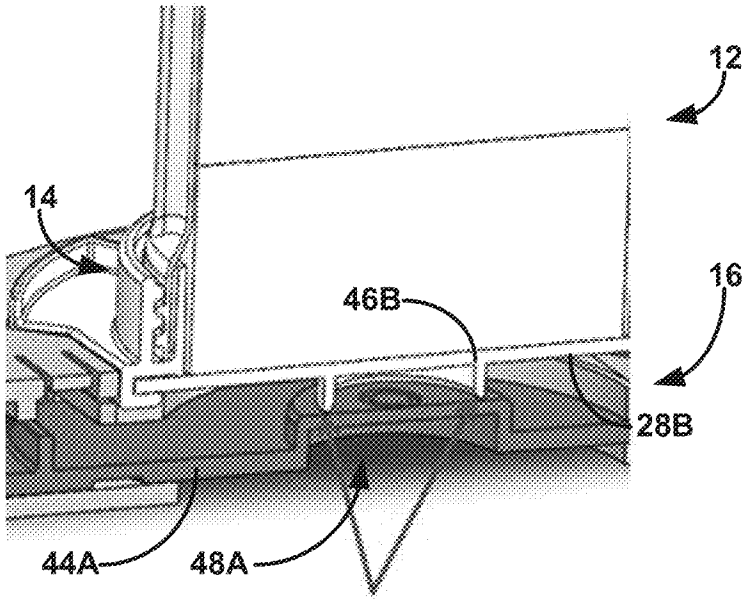
FIGS. 5A and 5B are side views of the example docking station configurations shown in FIGS. 4A and 5B showing the incompatibility of the complementary mating features between the two example embodiments.
Figure 5A:
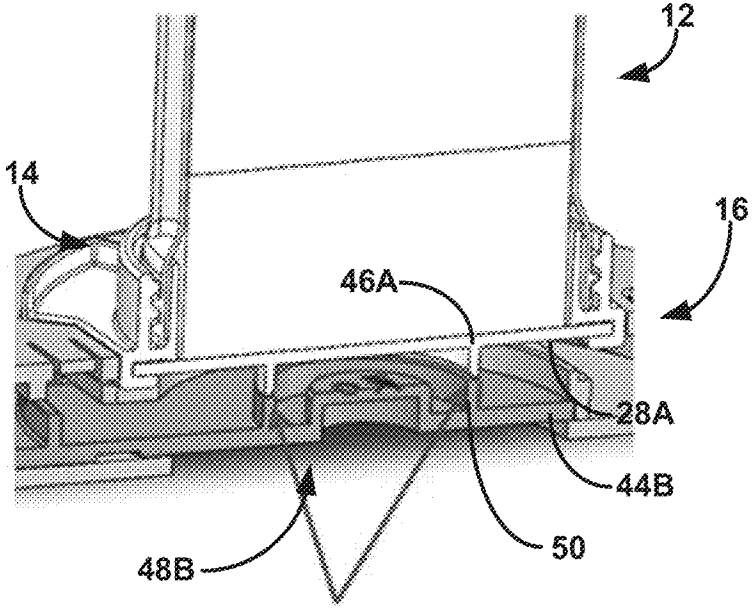

FIGS. 5A and 5B are side views of the example docking station configurations shown in FIGS. 4A and 5B showing the incompatibility of the complementary mating features between the two example embodiments. FIG. 5A illustrates the mating feature of slidable closure 28A interacting with the mating feature of docking station slide 44B. FIG. 5B illustrates the mating feature of slidable closure 28B interacting with the mating feature of docking slide 44A. In these examples, the mating features between the slidable closure and docking station slide interfere with each other, preventing the docking flange on one reservoir from being inserted into the other docking station and locked therein. In the example of FIG. 5A, a ring or annulus 50 of substantially equal size and/or shape of annulus 46A is offset from cylinder 48B to deliberately interfere with annulus 46A. Through deliberate design of corresponding engaging and interfering features, each docking station may be configured to receive only a particular type of reservoir containing a particular type of chemical product and may block or otherwise prevent an operator from inadvertently inserting a different type of reservoir containing a different type of product.

With further reference to FIGS. 3A and 3B, docking station 16 is illustrated as defining a discharge aperture 52. Discharge aperture 52 can be selectively opened and closed with docking station slide 44. Discharge aperture 52 may be an opening through housing 40 through which chemical dispensed from reservoir 12 can pass. In some examples, discharge aperture 52 is sized as large are larger than opening 30 extending through the bottom surface of reservoir 12 (FIG. 2B). In either case, discharge aperture 52 may be positioned such that, when docking flange 14 is properly inserted into docking station 16, opening 30 is aligned with the discharge aperture. The opening 30 may be aligned with discharge aperture 52 so that chemical product discharging from reservoir 12 through the opening 30 can pass through the discharge aperture and into the receiving space to which the docking station is connected. In some examples, opening 30 may be aligned with discharge aperture 52 such that a geometric center of the opening and discharge aperture are substantially co-linear (e.g., on a vertical axis passing through the geometric centers).

To engage reservoir 12 with docking station 16 to dispense chemical, docking flange 14 may be engaged with the docking station. The specific manner in which docking flange 14 engages docking station 16 may vary depending on the features and configuration of the docking flange, as described above. In the illustrated example, docking station 16 defines a recessed receiving cavity 54 configured to receive docking flange 14. Receiving cavity 54 may define a pocket or recess space relative to the top surface of docking station 16 into which docking flange 14 can be inserted. In the illustrated configuration, docking flange 14 is inserted into receiving cavity 54 by moving the docking flange and attached reservoir 12 downwardly (in the negative Z-direction indicated on FIG. 3A). In other configurations, docking flange 14 may be inserted into docking station 16 from the side (e.g., by moving the docking flange in the X-direction and/or Y-direction indicated on FIG. 4A).

To help prevent reservoir 12 from inadvertently detaching from docking station 16 while dispensing chemical product, the reservoir may be reversibly locked to the docking station. In some examples, docking flange 14 is configured to rotationally lock to the docking station. With reference to FIG. 3A, receiving cavity 54 is illustrated as having at least one ledge, which is illustrated as two ledges 56A and 56B (collectively "ledges 56"), overhanging the bottom of the receiving cavity and positioned on opposite sides of the receiving cavity. In use, a user may insert docking flange 14 into receiving cavity 54 with wings 34 offset from ledges 56 until the wings are positioned below the bottommost edge of the ledges. Thereafter, the user may rotate reservoir 12, causing wings 34 to move under ledges 56, thereby locking the reservoir to the docking station.

The specific number, configuration, and arrangement of ledges may correspond to the number, configuration, and arrangement of wings or other structures provided on docking flange 14. In some examples, the user may interlock the reservoir to the docking station by pushing the reservoir downwardly into the docking station and further rotating the reservoir, e.g., between 30° and 180°, such as 90°. To remove the reservoir after dispensing chemical product from the reservoir through the docking station, the user may reversibly rotate the reservoir an equivalent angular amount and pull the reservoir upwardly.

Figure 6B:
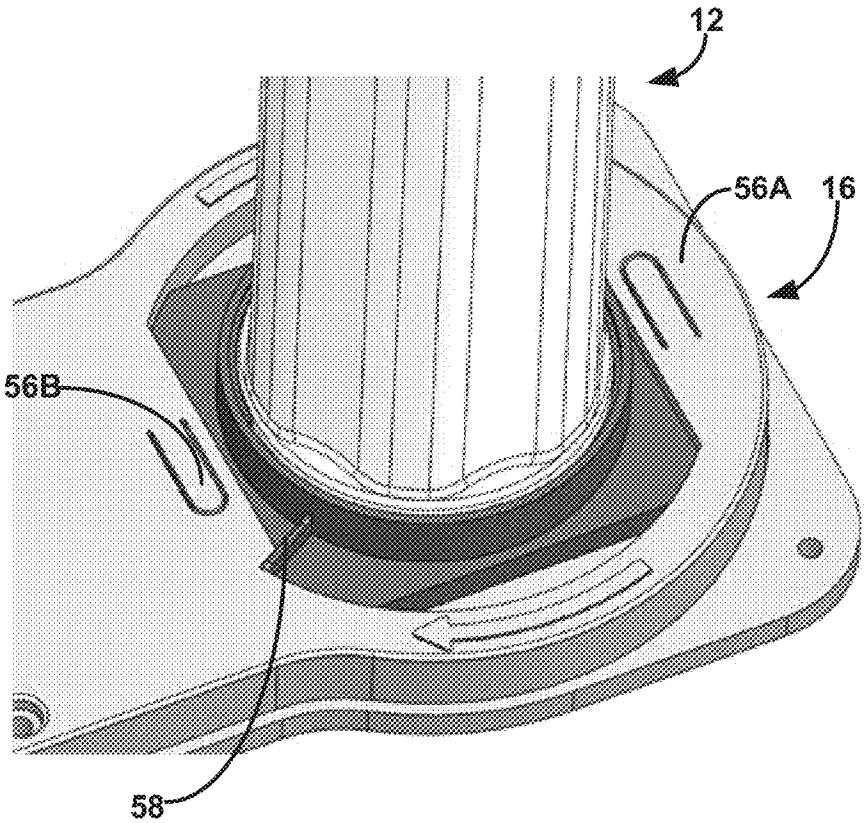
FIGS. 6A and 6B are perspective views illustrating example insertion positions by which a docking flange may be inserted into a docking station in the example of FIG. 1.
Figure 6A:
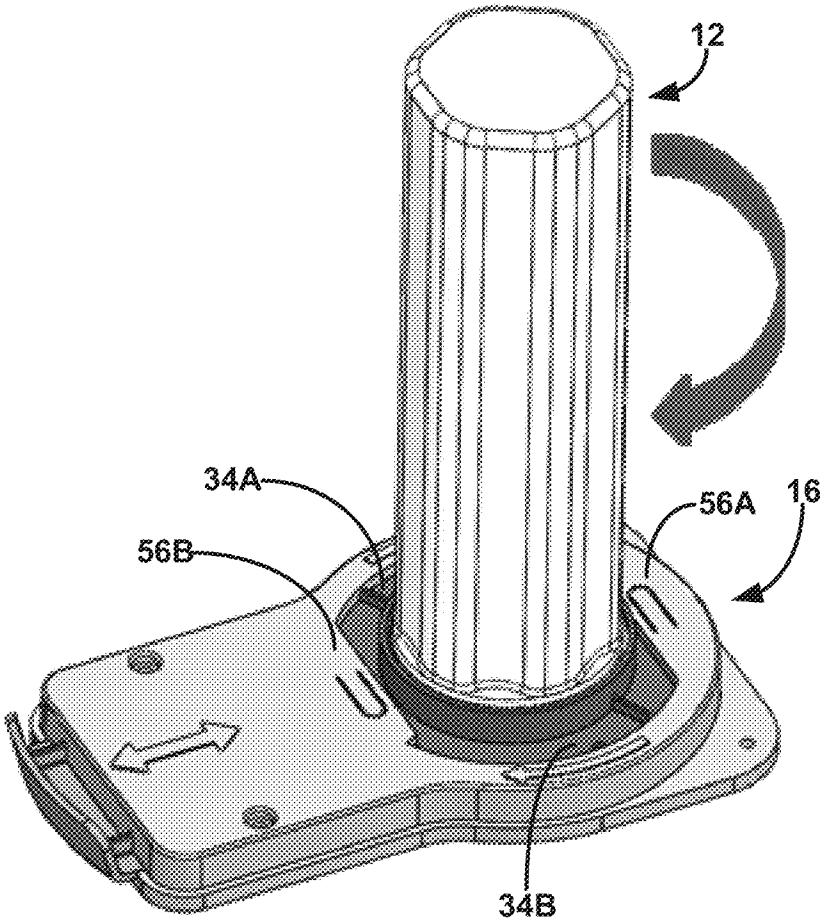

FIGS. 6A and 6B are perspective views illustrating example insertion positions by which the docking flange may be inserted into the docking station in the example system of FIG. 1. FIG. 6A illustrates docking flange 14 inserted into docking station 16 with wings 34 positioned circumferentially and rotationally offset from ledges 56. FIG. 6B illustrates docking flange 14 rotationally interlocked into docking station 16. When so interlocked, wing 34A can be positioned under ledge 56A and wing 34B can be positioned under ledge 56B. A detent 58 may be provided to stop over rotation when locking reservoir 12 into the docking station.

With further reference to FIG. 1, docking station slide 44 may include a handle 60 extending out of the docking station. Handle 60 may be any region or feature that is graspable by a user to manipulate docking station slide 44 to translate the docking station slide. In some examples, handle 60 includes an upwardly or downwardly curved section to define a notch 62 into which a user can insert their fingertips for grasping and pulling the handle.

Docking station slide 44 may be arranged to move in any suitable direction in order to actuate slidable closure 28 on reservoir 12, when the reservoir is inserted into the docking station. In the example of FIG. 1, docking station slide 44 is configured to move orthogonally relative to discharge aperture 52 and the direction chemical product discharges from reservoir 12. When so configured, slidable closure 28 may also move orthogonally relative to the direction chemical product discharges from reservoir 12 in response to actuation of docking station slide 44. In other configurations, docking station slide 44 and/or slidable closure 28 may move at other angles relative to the direction chemical product discharges to open and close the reservoir. For example, docking station slide 44 and/or slidable closure 28 may be arranged in an acute or obtuse angle relative to the discharge direction.

In general, docking station slide 44 and/or slidable closure 28 may assume any suitable arrangement such that slidable closure 28 can be moved from a covering position to an offset position. In a covering position, slidable closure 28 can block or prevent chemical from discharging through opening 30 at the bottom end of the reservoir, e.g., by providing a physical barrier that chemical product cannot bypass when closed. In an offset position, slidable closure can be moved to the side of opening 30 such that chemical product is allowed to discharge past the slidable closure through opening 30. Chemical product may pass the slidable closure 28 by flowing through opening 30 and align the discharge aperture 52 well the opening is partially or fully uncovered by retraction of the slidable closure.

In the example of FIG. 1, housing 40 of docking station 16 includes a reservoir receiving portion 42 and a docking station slide retaining portion 66. Docking station slide retaining portion 66 is a laterally offset (e.g., in the X-Y plane indicated on FIG. 1) but integrally connected to reservoir receiving portion 42 in the illustrated example. Docking station slide retaining portion 66 may define a portion of housing 40 retaining and/or surrounding docking station slide 44. Docking station slide retaining portion 66 may include channels along which docking station slide 44 can slide to translate between open and closed positions. At least a portion of slidable closure 28 (and, in some examples, an entirety of the slidable closure) may be drawn into docking station slide retaining portion 66 when the opening on the bottom of reservoir 12 is opened.

Figure 7:
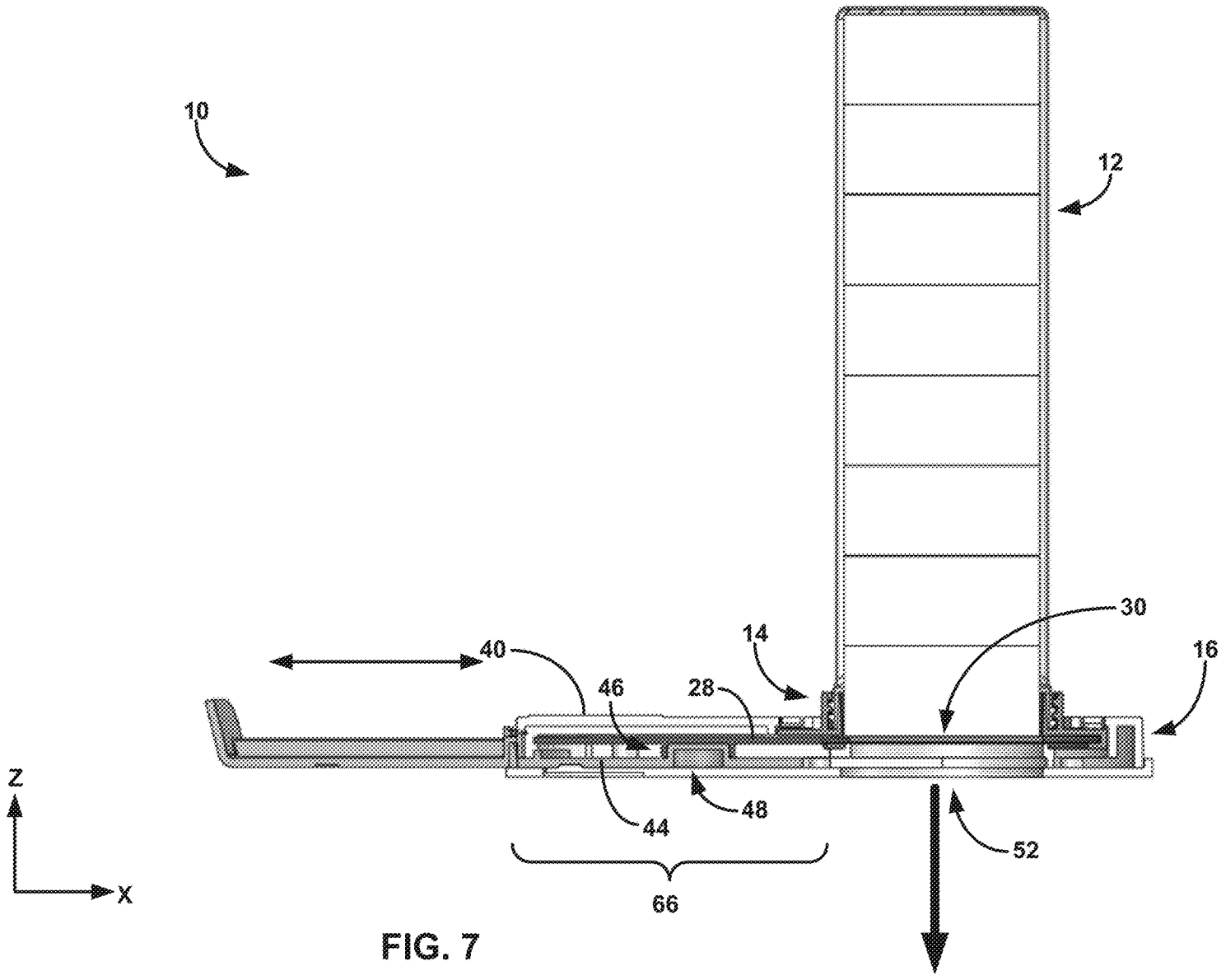
FIG. 7 is a side view of the chemical dispensing system from FIG. 1 showing an example arrangement of components.

FIG. 7 is a side view of chemical dispensing system 10 from FIG. 1 showing an example arrangement of components when slidable closure is offset to open reservoir 12. As shown in this example, docking station slide 44 is engaged with slidable closure 28, and both the docking station slide and slidable closure have been translated to an offset or open position. Accordingly, slidable closure 28 is withdrawn into docking station slide retaining portion 66. This results in slidable closure 28 being vertically stacked on top of docking station slide 44 within docking station slide retaining portion 66. By moving the slidable closure 28 and docking station slide 44 to an offset position, opening 30 in the bottom of reservoir 12 may be may be uncovered, allowing chemical product in reservoir 12 to discharge through the opening and through the aligned discharge aperture 52 in docking station 16.

In some examples, reservoir 12 and docking station 16 are designed and arranged so that chemical product in the reservoir discharges under the force of gravity when the reservoir is opened using the docking station. For example, reservoir 12 may be oriented so a gravitational force vector causes chemical product in reservoir 12 to flow toward opening 30 without requiring additional biasing force to empty the reservoir. In other examples, a biasing force (e.g., spring force, compressed gas, external driver) may be applied to the contents in reservoir 12 to help facilitate efficient discharge of the contents upon opening the reservoir using docking station 16.

Chemical reservoir 12 may contain any type of material desired to be stored and dispensed using the reservoir. Example chemicals that may be stored and dispensed using reservoir 12 include, but are not limited to, an oxidizing biocide, a non-oxidizing biocide, a sanitizers, a sterilant, a cleaner, a degreaser, a lubricant, a detergent, a stain remover, a rinse agent, an enzyme, and the like. The chemical may be in a solid form, a liquid form, or a pseudo-solid/liquid form, such as a gel or paste.

In applications where the chemical is in a solid form, the solid chemical may be formed by casting, extruding, molding, and/or pressing. The solid chemical filling reservoir 12 may be structured as one or more blocks of solid chemical, a powder, a flake, a granular solid, or other suitable form of solid. For example, the solid chemical may be formed into a puck having a shape matching the cross-sectional shape of reservoir 12 (in the X-Y plane). The reservoir may be filled with a plurality of pucks stacked vertically one on top of another. Examples of solid product suitable for use in reservoir 12 are described, for example, in U.S. Pat. Nos. 4,595,520, 4,680,134, U.S. Reissue Pat. Nos. 32,763 and 32,818, U.S. Pat. Nos. 5,316,688, 6,177,392, and 8,889,048.

In applications where the chemical is in a liquid or pseudo-liquid form (e.g., a gel), reservoir may or may not include a film further covering opening 30. The film may be a polymeric film, a metal or metallized film, or other film structure. The film may be positioned between slidable closure 28 and opening 30, such that the contents of reservoir 12 are bound by the film positioned in front of the slidable closure. In such examples, slidable closure 28 may be operatively coupled to the film. Accordingly, the film may be retracted or otherwise removed from opening 30 as slidable closure 28 is moved to an offset or open position. Additionally or alternatively, the film may be positioned outside of slidable closure 28, such that the contents of reservoir 12 are bound by the slidable closure and the film acts as a secondary barrier to prevent inadvertent bypass around the slidable closure. In these examples, the user may remove the film from reservoir 12 prior to inserting the reservoir into docking station 16.

As noted above, docking station 16 may be attached to a receiving reservoir 18 that is intended to receive the discharged contents of reservoir 12. Docking station 16 may include mechanical fixation features, such as an adhesive strip, screw or bolt holes for receiving screws or bolts, clips or snaps, or other fixation features to attach the docking station 16 to the surface of the receiving reservoir. Receiving reservoir 18 may be any structure that is intended to receive the contents of reservoir 12. Example structures may include a laundry machine, a ware wash machine, a chemical product dispenser, a medical sanitization machine, pool and/or spa equipment, or any other type of receiving reservoir. In the case of a chemical product dispenser, which may or may not be integrated into one of the foregoing example pieces of equipment described, the chemical received by the dispenser from reservoir 12 may be combined with a solvent to reduce the concentration of the chemical. For example, the chemical product dispenser may introduce an aqueous or organic solvent that contacts the chemical received from reservoir 12 to form a dischargeable liquid solution. Where the chemical received from reservoir 12 is a solid, the surface of the solid product may erode by degrading and/or shearing off from the remainder of the solid in response to being wetted with fluid. In different examples, the solid chemical may or may not react with fluid introduced by the chemical dispenser to form a resulting chemical solution dispensed from the dispenser.

Figure 8A:
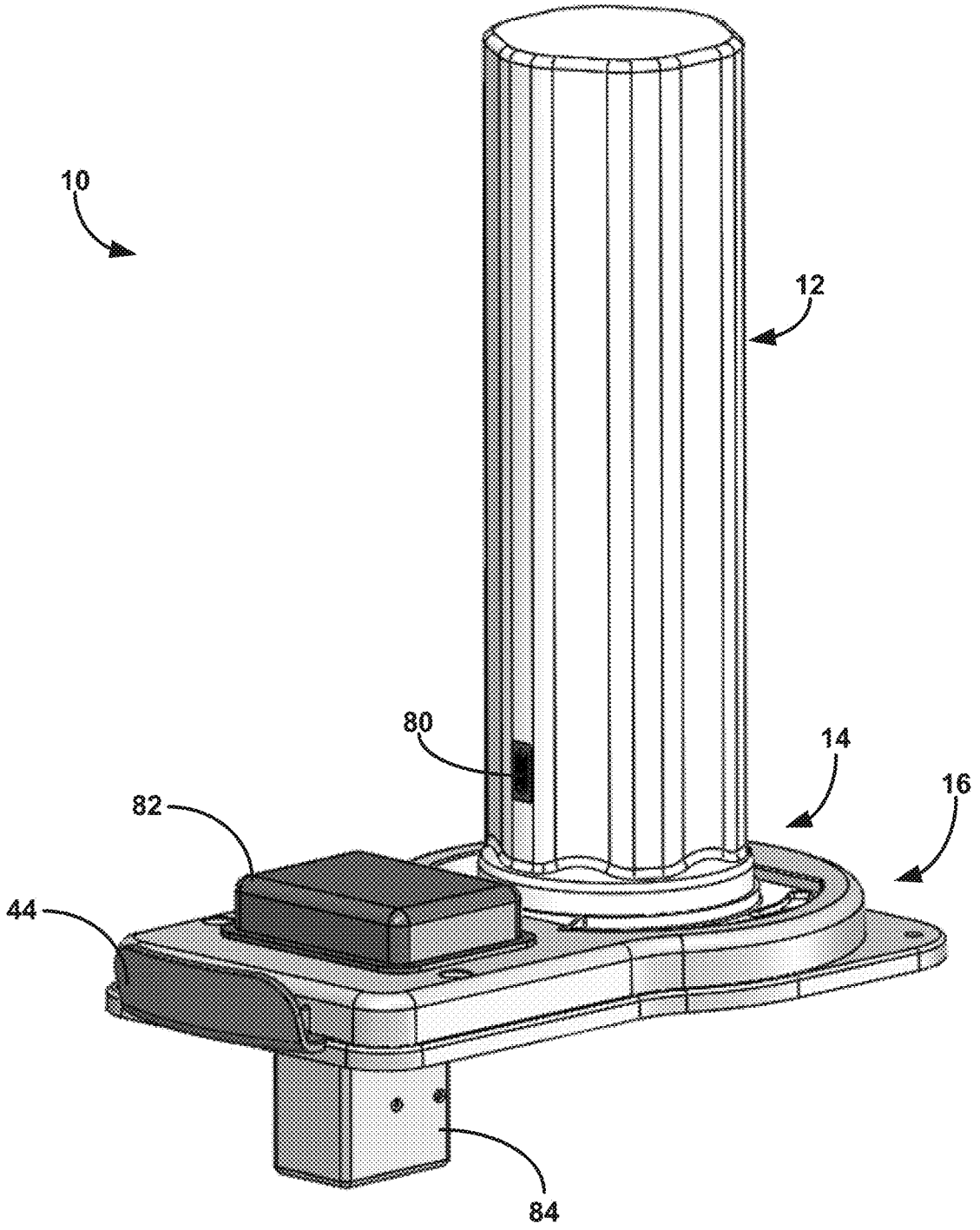
FIGS. 8A and 8B are different views of a chemical dispensing system showing additional example chemical reservoir authentication features that may be included.
Figure 8B:
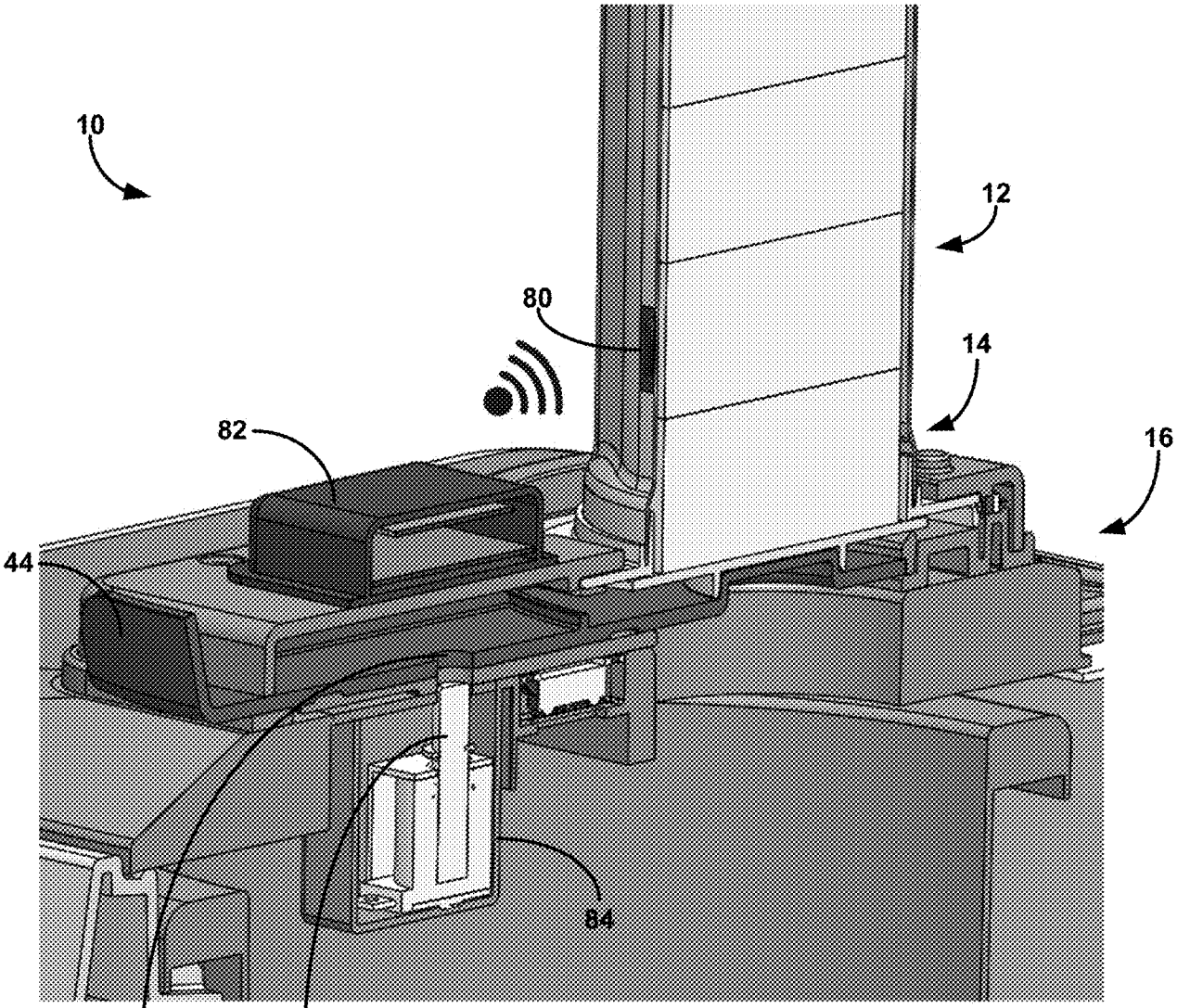

Chemical dispensing system 10 may include a variety of additional or different features to help ensure that a user does not inadvertently attach a reservoir containing the wrong chemical to a docking station. FIGS. 8A and 8B are different views of a chemical dispensing system 10 showing additional chemical reservoir authentication features that may be included in the system. FIG. 8A is a perspective view of the system, while FIG. 8B is a side sectional view of the system.

As shown in the illustrated example, chemical dispensing system 10 includes previously described reservoir 12, docking flange 14, and docking station 16. System 10 in the example of FIGS. 8A and 8B differs from the previously described example system in that reservoir 12 includes a machine-readable tag 80. In addition, docking station 16 includes an electronic reader 82 configured to read the machine-readable tag 80 on reservoir 12. Docking station 16 also includes a lock 84 that can prevent actuation of docking station slide 44 (and, correspondingly, slidably closure 28) if information read from machine-readable tag 80 does not indicate that the contents of reservoir 12 are authorized to be dispensed.

Machine-readable tag 80 can be any type of tag suitable for use with a noncontact reader. For example, machine-readable tag 80 may be a Radio Frequency Identification Tag (RFID), a Near Field Communication Tag (NFC), a barcode, or other tag containing machine readable information. Electronic reader 82 may be a noncontact reader that is configured to read the type of machine-readable information encoded on or in tag 80. For example, electronic reader 82 may be an optical or electromagnetic reader that can scan, activate, or otherwise interact with machine readable tag 80 to extract information stored on or in the machine-readable tag.

In operation, reader 82 may read information stored on or in machine-readable tag 80 and compare that information with corresponding information stored in a non-transitory memory associated with the system. The machine-readable tag can contain information identifying reservoir 12 and/or the contents therein, such as a code, manufacturing number, name, or other suitable information. A controller associated with the system can compare the information read from machine-readable tag 80 via reader 82 with information stored in memory to determine if reservoir 12 and/or the contents contained therein are suitable to be dispensed to the discharge location to which docking station 16 is attached. If the controller determines that reservoir 12 and/or the contents contained therein are authorized, the controller may control lock 84 to unlock the system, thereby allowing an operator to actuate docking station slide 44. By contrast, if the controller determines that reservoir 12 and/or the contents contained therein are not authorized, the controller may not unlock lock 84, thereby preventing the operator from actuating docking station slide 44 and discharging the contents of the reservoir.

In the example of FIG. 8B, lock 84 is illustrated as including a piston 86 that is extendable up into and retractable from a locking aperture 88 in docking station slide 44. In this configuration, piston 86 may be extended into the locking aperture 88 to lock docking station slide 44. Piston 86 may correspondingly be retracted from the locking aperture 88 to unlock docking station slide 44. Other locking configurations can be used in a docking station lock without departing from the scope of the disclosure.

Figure 9A:
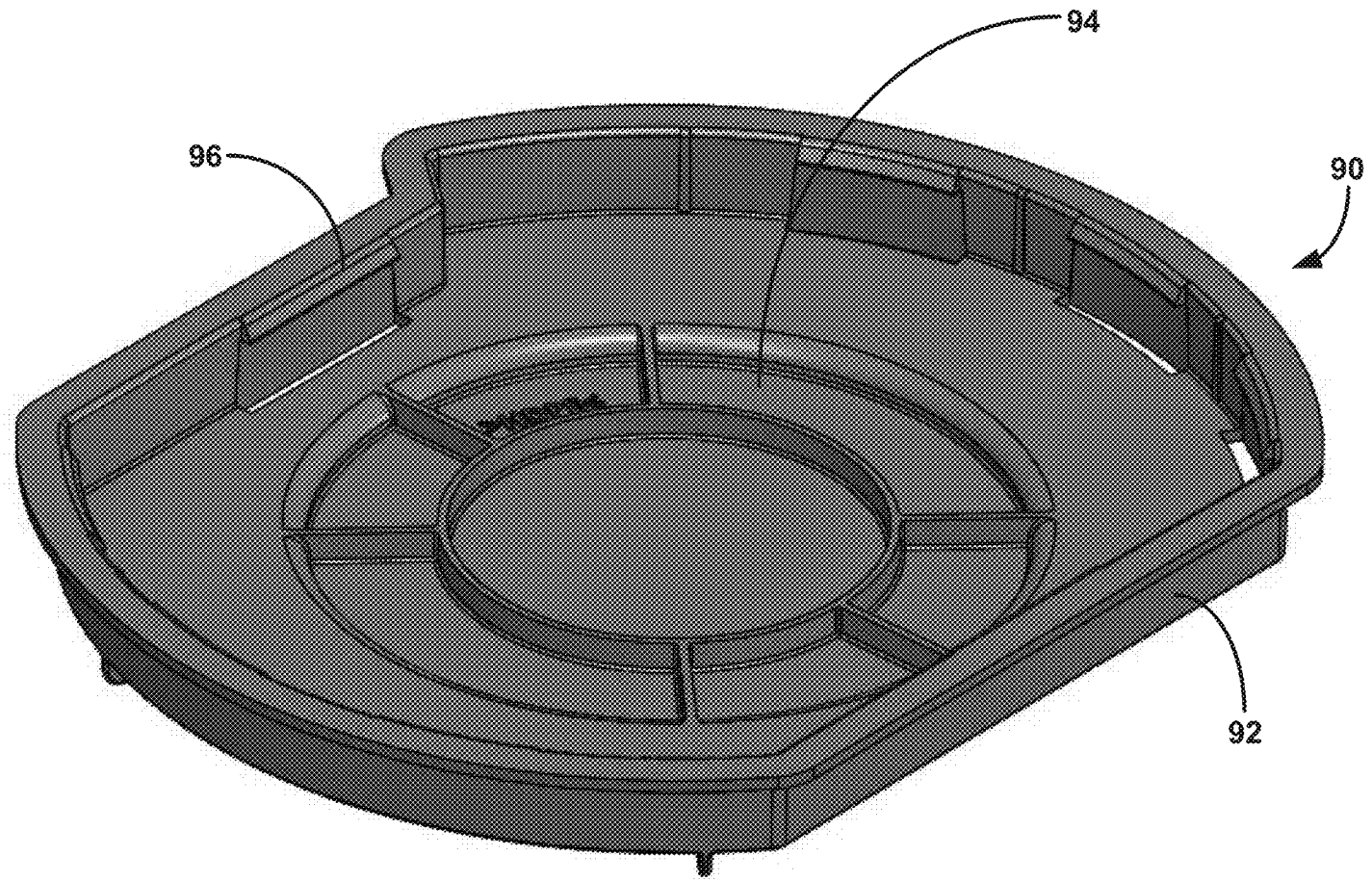
FIG. 9A is a perspective view of an example cover that may be used to cover a docking flange before use.
Figure 9B:
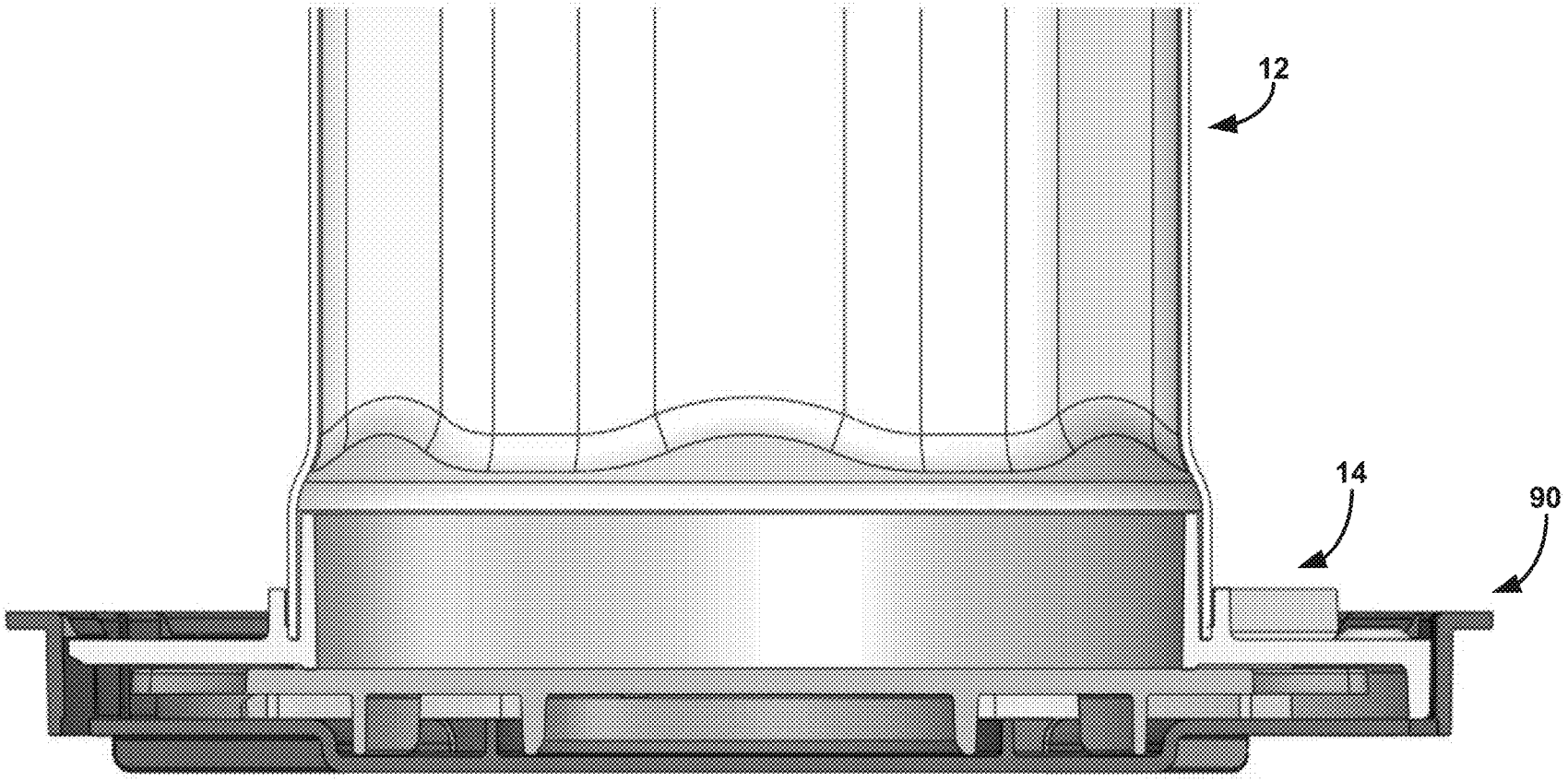
FIG. 9B is a sectional side view showing the example cover of FIG. 9A installed over an example docking flange.

In practice, reservoir 12 with connected docking flange 14 may be transported to a location of intended use and stored before being taken from storage and engaged with docking station 16. To help prevent docking flange 14 from opening and the contents of reservoir 12 from inadvertently discharging before intended deployment, a removable cover may be provided over docking flange 14. FIG. 9A is a perspective view of an example cover 90 that may be used to cover docking flange 14 before use. FIG. 9B is a sectional side view showing the example cover 90 of FIG. 9A installed over a docking flange.

In the illustrated configuration of FIGS. 9A and 9B, cover 90 is illustrated as define a cavity with a bottom wall and upwardly extending sidewalls 92 that extend along the bottom surface and sidewalls, respectively, of docking flange 14. The bottom wall of cover 90 includes recessed pocket(s) 94 configured to receive the a ring, annulus, or other interference feature 46 of slidable closure 28. In addition, cover 90 is illustrated as having one or more laterally extending deformable tabs 96. The one or more tabs are configured to extend over a top surface of docking flange 14, when cover 90 is attached to the docking flange, and reversibly and deformably move away from the top surface to release the cover from the flange. In some examples, cover 90 is formed from a polymeric material, and may be sufficiently flexible to deform under human hand pressure.

As noted above, docking flange 14 can define an opening 30 through which chemical can dispensed from reservoir 12. Opening 30 may have a cross-sectional size (area) substantially equal to a cross-sectional size of reservoir 12 (in the X-Y plane) and/or discharge aperture 52 (e.g., plus or minus 5%). Alternatively, opening 30 may have a different size than a cross-sectional size of reservoir 12 (in the X-Y plane) and/or discharge aperture 52. For example, opening 30 may taper relative to reservoir 12 (in the X-Y plane) to define a narrower end relative to a majority of the reservoir. Such a taper may be achieve by tapering sidewall 20 of reservoir 12 adjacent terminal bottom end 24 and/or by tapering an inner wall surface of docking flange 14 relative to sidewall 20 of reservoir 12.

Figure 10A:
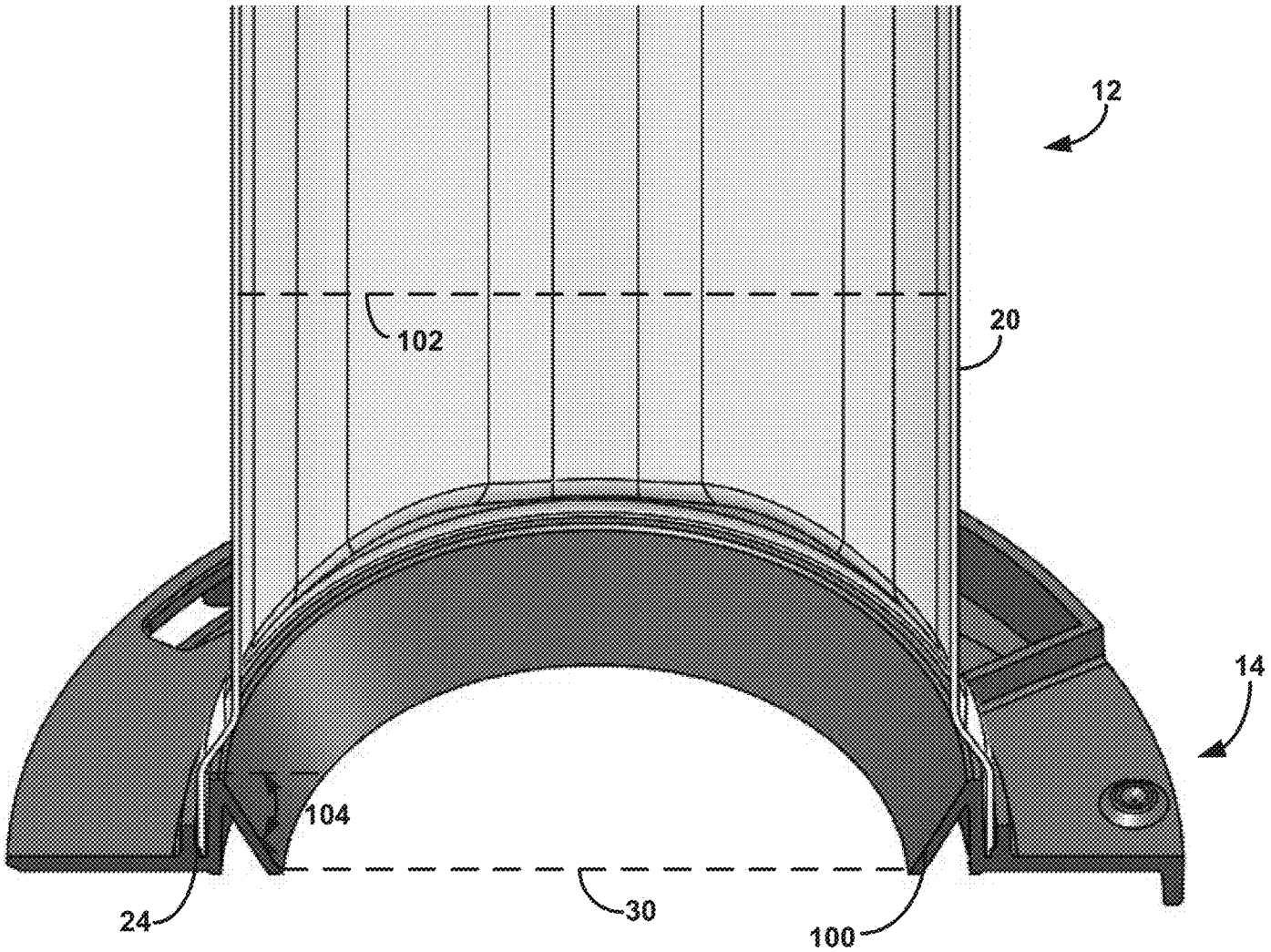
FIG. 10A is a sectional side view of an example configuration of a reservoir and a docking flange where the outlet opening is tapered.
Figure 10B:
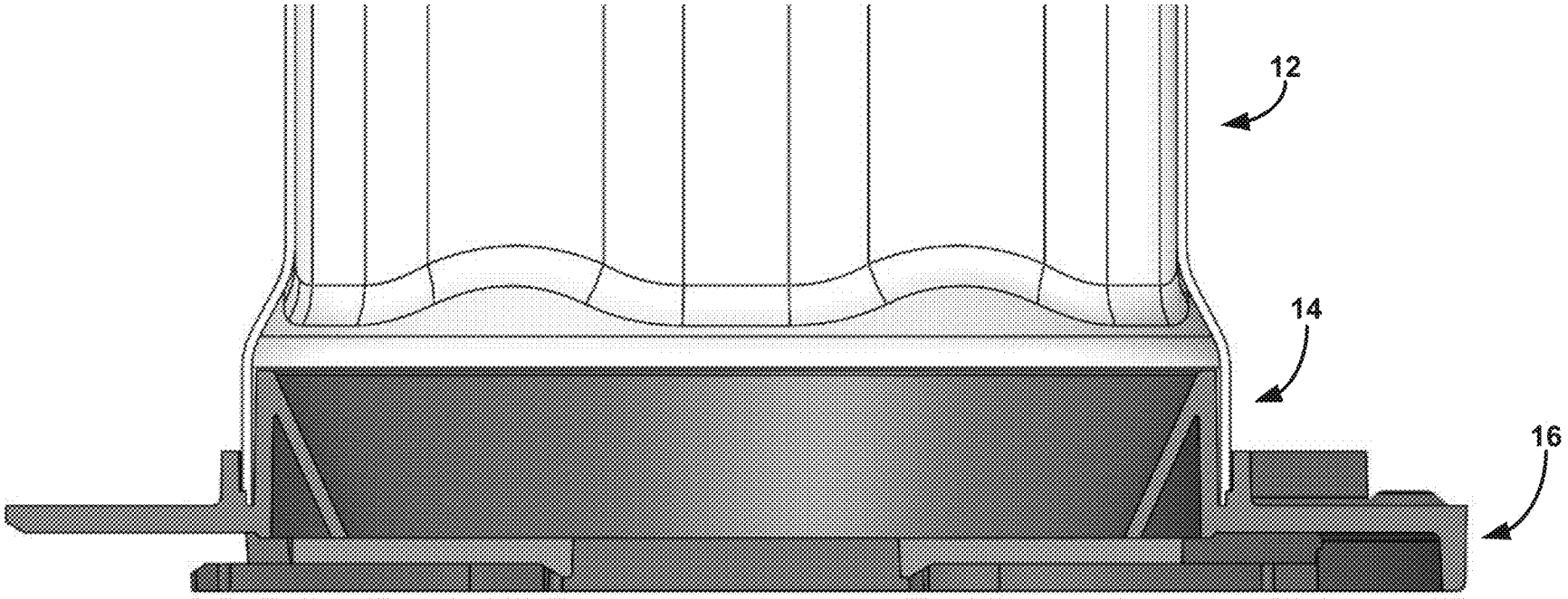
FIG. 10B is a side view of the example configuration of FIG. 10A installed in an example docking station.

FIG. 10A is a sectional side view of an example configuration of reservoir 12 and docking flange 14 where the outlet opening 30 is tapered. FIG. 10B is a side view of the example configuration of reservoir 12 and docking flange 14 from FIG. 10A installed in an example docking station 16. As shown in this example, an inner wall surface 100 of docking flange 14 is angled inwardly relative to an inner surface of sidewall 20. As a result, opening 30 has a smaller cross-sectional area than the cross-sectional area 102 of reservoir 12. In the illustrated configuration, docking flange 14 defines a frustoconical shape that tapers inwardly at an angle 104, although other wall surface shapes can be used to provide a reduction in cross-sectional area. When configured with an angled taper, angle 104 may range from 30 degrees to 85 degrees, such as from 55 degrees to 75 degrees, or from 60 degrees to 70 degrees.

Configuring reservoir 12 and/or docking flange 14 to narrow at the outlet of the respective features (e.g., adjacent terminal end 24) may be useful to facilitate efficient dispensing. For example, when reservoir 12 contains granular solid chemical to be dispensed, the addition of an outlet taper can define a funnel which narrows the dispensing orifice. This can help ensure that the chemical being dispensed discharges through the dispensing orifice without spilling.

A chemical dispensing system according to the disclosure may provide an efficient and safe dispensing environment for an operator to transfer chemical received from a manufacturer to an intended discharge location. The chemical may be discharged from the package in which it is received without the user physically contacting the chemical in the package. In some configurations, features such as electronically readable media on the reservoir and/or complementary connection features between the reservoir and docking station may be further provided to help prevent an operator from inadvertently attaching a package containing the wrong chemical to the wrong dispensing location.

Various examples have been described. These and other examples are within the scope of the following claims.

The invention claimed is:

1. A chemical dispensing system comprising:

a reservoir configured to contain a chemical to be dispensed, the reservoir having a closed top end, a bottom end defining an opening through which the chemical is dispensed, and at least one sidewall connecting the top end to the bottom end;

a docking flange adjacent the bottom end of the reservoir, the docking flange containing a slidable closure configured to slide from a position in which the slidable closure closes the opening of the reservoir to prevent the chemical from discharging through the opening to a position in which the slidable closure is offset from the opening and the chemical is allowed to discharge past the slidable closure through the opening, the docking flange having an open side through which the slidable closure is configured to translate;

a docking station having a discharge aperture and a docking station slide, the docking station being configured to receive and hold the docking flange extending from the bottom end of the reservoir with the opening of the reservoir aligned with the discharge aperture of the docking station, wherein the slidable closure and the docking station slide have corresponding mating features that cause the slidable closure to engage with the docking station slide, when the docking flange extending from the bottom end of the reservoir is inserted into the docking station, such that the slidable closure is configured to open as the docking station slide is translated from a closed position to an open position, the docking station comprises a housing having a reservoir receiving portion and a docking station slide retaining portion offset laterally from the reservoir receiving portion, the reservoir receiving portion defining a receiving cavity through which the discharge aperture extends and into which the docking flange is configured to be inserted, and the docking station slide retaining portion having a slidable closure opening through which the slidable closure is configured to slide, and the docking flange being configured to be inserted into the receiving cavity of the reservoir receiving portion with the open side of the docking flange out of alignment with the slidable closure opening of the docking station slide retaining portion and rotated until the open side of the docking flange is aligned with the slidable closure opening of the docking station slide retaining portion.

2. The system of claim 1, wherein the corresponding mating features comprises one of a projection and a protrusion on a bottom surface of the slidable closure and the other of the projection and the protrusion on a top surface of the docking station slide.

3. The system of claim 1, wherein the reservoir receiving portion is shape-indexed to the docking flange.

4. The system of claim 1, wherein the docking station slide retaining portion includes a docking station slide opening through which the docking station slide is configured to travel and the slidable closure opening is vertically above the docking station slide opening through which the slidable closure is configured to slide.

5. The system of claim 1, wherein the docking flange extends outwardly from the bottom end of the reservoir;

the housing of the docking station has a ledge extending over a portion of the receiving cavity, and the docking flange is configured to be inserted into the receiving cavity and rotated until at least a portion of the docking flange is positioned under the ledge.

6. The system of claim 1, wherein the docking flange is substantially circular with at least one chamfered edge.

7. The system of claim 1, wherein the reservoir defines a vertically elongated body having a cross-sectional size substantially equal to a cross-sectional size of both the opening and the discharge aperture.

8. The system of claim 1, wherein the docking station slide is configured to slide from a position in which the docking station slide closes the discharge aperture to a position in which the docking station slide is offset from the discharge aperture.

9. The system of claim 1, wherein the docking flange defines a pair of channels into which opposed sides of the slidable closure are inserted and along which the slidable closure slides.

10. The system of claim 1, wherein the reservoir contains the chemical, and the chemical is one of a solid block, solid pucks, and solid granules.

11. A chemical dispensing reservoir comprising:

a reservoir configured to contain a chemical to be dispensed, the reservoir having a closed top end, a bottom end defining an opening through which the chemical is dispensed, and at least one sidewall connecting the top end to the bottom end; and a docking flange adjacent the bottom end of the reservoir, the docking flange containing a slidable closure configured to slide from a position in which the slidable closure closes the opening of the reservoir to prevent the chemical from discharging through the opening to a position in which the slidable closure is offset from the opening and the chemical is allowed to discharge past the slidable closure through the opening, wherein a bottom surface of the slidable closure comprises one of a projection and a protrusion configured to mate with a corresponding protrusion or projection of a docking station slide, thereby allowing the slidable closure to open as the docking station slide is translated from a closed position to an open position, and the docking flange has an opening through which the slidable closure is configured to translate, the docking flange being configured to be rotationally interlocked with a docking station, thereby moving the opening of the docking flange from being out of alignment with a slidable closure opening of the docking station to being aligned with the slidable closure opening of the docking station.

12. The reservoir of claim 11, wherein the docking flange extends outwardly from the bottom end of the reservoir.

13. The reservoir of claim 11, wherein the docking flange is substantially circular with at least one chamfered edge about its perimeter.

14. The reservoir of claim 11, wherein the closed top end, bottom end, and at least one sidewall collectively define a vertically elongated body having a cross-sectional size substantially equal to a cross-sectional size of the opening.

15. A method of dispensing chemical comprising:

inserting a reservoir containing a chemical that is held in the reservoir by a slidable closure into a docking station, the docking station having a docking station slide closing a discharge aperture extending through the docking station;

engaging the slidable closure on the reservoir with the docking station slide; and sliding the docking station slide and thereby simultaneously sliding the slidable closure on the reservoir engaged therewith, causing an opening through a bottom end of the reservoir to open simultaneously with the discharge aperture;

wherein inserting the reservoir into the docking station comprises rotationally interlocking the reservoir with the docking station, thereby moving an opening through which the slidable closure translates from being out of alignment with a slidable closure opening of the docking station to being aligned with the slidable closure opening of the docking station.

16. The method of claim 15, wherein inserting the reservoir into the docking station comprises inserting a flange extending from the bottom end of the reservoir into a receiving cavity of the docking station and rotating the reservoir to position the flange under a ledge extending over a portion of the receiving cavity.

17. The method of claim 15, wherein engaging the slidable closure on the reservoir with the docking station slide comprises inserting one of a projection and a protrusion on a bottom surface of the slidable closure into the other of the projection and the protrusion on a top surface of the docking station slide.

18. The method of claim 15, wherein the chemical is a biocide.

19. The method of claim 1, wherein the docking flange is configured to be rotated between 30° and 180° .

* * * * *